US008433076B2

(12) United States Patent
Zurek et al.

(10) Patent No.: US 8,433,076 B2
(45) Date of Patent: Apr. 30, 2013

(54) ELECTRONIC APPARATUS FOR GENERATING BEAMFORMED AUDIO SIGNALS WITH STEERABLE NULLS

(75) Inventors: Robert Zurek, Antioch, IL (US); Kevin Bastyr, St. Francis, WI (US); Joel Clark, Woodridge, IL (US); Plamen Ivanov, Schaumburg, IL (US)

(73) Assignee: Motorola Mobility LLC, Libertyville, IL (US)

( * ) Notice: Subject to any disclaimer, the term of this patent is extended or adjusted under 35 U.S.C. 154(b) by 469 days.

(21) Appl. No.: 12/843,555

(22) Filed: Jul. 26, 2010

(65) Prior Publication Data

US 2012/0019689 A1 Jan. 26, 2012

(51) Int. Cl.
*H04R 3/00* (2006.01)

(52) U.S. Cl.
USPC ..... 381/92; 348/175

(58) Field of Classification Search ..... 381/92, 381/94.1, 94.7, 300, 59, 86, 18, 302, 313, 381/312, 355, 57, 80, 81, 1, 2, 26, 91, 122, 381/356; 348/175, 231.4; 700/94
See application file for complete search history.

(56) References Cited

U.S. PATENT DOCUMENTS

| | | | | |
|---|---|---|---|---|
| 4,334,740 | A | 6/1982 | Wray | |
| 4,985,874 | A | 1/1991 | Roeschlein | |
| 5,031,216 | A | 7/1991 | Gorike et al. | |
| 6,031,216 | A | 2/2000 | Goerike et al. | |
| 6,041,127 | A | 3/2000 | Elko | |
| 6,507,659 | B1 | 1/2003 | Iredale et al. | |
| 7,020,290 | B1 | 3/2006 | Ribic | |
| 7,206,418 | B2 * | 4/2007 | Yang et al. | 381/92 |
| 7,206,421 | B1 | 4/2007 | Taenzer | |

(Continued)

FOREIGN PATENT DOCUMENTS

GB 2418332 A 3/2006

OTHER PUBLICATIONS

Patent Cooperation Treaty, "PCT Search Report and Written Opinion of the International Searching Authority" for International Application No. PCT/US2011/041157, Oct. 31, 2011, 10 pages.

(Continued)

*Primary Examiner* — Vivian Chin
*Assistant Examiner* — Friedrich W Fahnert
(74) *Attorney, Agent, or Firm* — Ingrassia Fisher & Lorenz, P.C.; Erin P. Madill; Sylvia Chen

(57) ABSTRACT

An electronic apparatus is provided having a front side and a rear side oriented in opposite directions along a first axis, and a right-side and a left-side oriented in opposite directions along a second axis that is perpendicular to the first axis. A null control signal is generated based on an imaging signal. A first microphone located near the right-side of an electronic apparatus generates a first signal and a second microphone located near the left-side of the electronic apparatus generates a second signal. The first and second signals are processed, based on the null control signal, to generate a right beamformed audio signal having a first directional pattern having at least one first null, and a left beamformed audio signal having a second directional pattern having at least one second null. A first angular location (α) of the at least one first null and a second angular location (β) of the at least one second null are steered based on the null control signal.

19 Claims, 15 Drawing Sheets

U.S. PATENT DOCUMENTS

| | | | | |
|---|---|---|---|---|
| 2003/0160862 | A1 | 8/2003 | Charlier et al. | |
| 2006/0140417 | A1 | 6/2006 | Zurek | |
| 2006/0221177 | A1 | 10/2006 | Chu et al. | |
| 2006/0269080 | A1 | 11/2006 | Oxford et al. | |
| 2007/0263888 | A1 | 11/2007 | Melanson | |
| 2008/0170718 | A1 | 7/2008 | Faller | |
| 2009/0010453 | A1 | 1/2009 | Zurek et al. | |
| 2009/0055170 | A1* | 2/2009 | Nagahama | 704/226 |
| 2010/0110232 | A1 | 5/2010 | Zhang et al. | |
| 2011/0275434 | A1* | 11/2011 | Cheng et al. | 463/36 |
| 2012/0013768 | A1* | 1/2012 | Zurek et al. | 348/231.4 |

OTHER PUBLICATIONS

Gary W. Elko, "Superdirectional Microphone Arrays" and Yiteng (Arden) Huang, et al., "Microphone Arrays for Video Camera Steering" in Steven L. Gay and Jacob Benesty (editors), "Acoustic Signal Processing for Telecommunication", 2000, pp. 181-237 and pp. 239-259, Kluwer Academic Publishers.

* cited by examiner

ELECTRONIC APPARATUS FOR GENERATING BEAMFORMED AUDIO SIGNALS WITH STEERABLE NULLS

TECHNICAL FIELD

The present invention generally relates to electronic devices, and more particularly to electronic devices having the capability to selectively acquire stereo spatial audio information.

BACKGROUND

Conventional multimedia audio/video recording devices, such as camcorders, commonly employ relatively expensive directional microphones for stereo recording of audio events. Such directional microphones have directional beamform patterns with respect to an axis, and the orientation or directionality of the microphones' beamforms can be changed or steered so that the beamform points or is oriented toward a particular direction where the user wants to record sound events.

Notwithstanding these advances in audio/video recording devices, it can be impractical to implement directional microphones in other types of portable electronic devices that include audio and video recording functionality. Examples of such portable electronic devices include, for example, digital wireless cellular phones and other types of wireless communication devices, personal digital assistants, digital cameras, video recorders, etc.

These portable electronic devices include one or more microphones that can be used to acquire and/or record audio information from a subject or subjects that is/are being recorded. In some cases, two microphones are provided on opposite ends of the device (e.g., located near the right-side and left-side of the device) so that when the device is used for audio/video acquisition the microphones are positioned for recording one or more subject(s).

The number of microphones that can be included in such devices can be limited due to the physical structure and relatively small size of such devices. Cost is another constraint that can make it impractical to integrate additional microphones in such devices for the sole purpose of multimedia acquisition and/or recording. This is particularly true with regard to directional microphones because they tend to be more expensive and more difficult to package than omnidirectional microphones. Additionally, the microphones in these types of devices have to serve multiple use cases such as private voice calls, speakerphone calls, environmental noise pickup, multimedia recording, etc. As a result, device manufacturers will often implement less expensive omnidirectional microphones. In short, the space and/or cost of adding additional microphone elements is a factor that weighs against inclusion of more than two microphones in a device.

At the same time, it is desirable to provide stereo recording features that can be used with such portable electronics devices so that an operator can record sound events with stereo characteristics.

Accordingly, there is an opportunity to provide portable electronic devices having the capability to acquire stereo audio information using two microphones that are located at or near different ends/sides of the portable electronic device. It is also desirable to provide methods and systems within such devices to enable stereo acquisition or recording of audio sources consistent with a video frame being acquired regardless of the distance between those audio sources and the device. Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

DETAILED DESCRIPTION

As used herein, the word "exemplary" means "serving as an example, instance, or illustration." The following detailed description is merely exemplary in nature and is not intended to limit the invention or the application and uses of the invention. Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims. Furthermore, there is no intention to be bound by any expressed or implied theory presented in the preceding technical field, background, or the following detailed description.

Before describing in detail embodiments that are in accordance with the present invention, it should be observed that the embodiments reside primarily in an electronic apparatus that has a front side and a rear side oriented in opposite directions along a first axis, and a right-side and a left-side oriented in opposite directions along a second axis that is perpendicular to the first axis. The electronic apparatus also includes a first microphone located near the right-side of an electronic apparatus that generates a first signal, and a second microphone located near the left-side of the electronic apparatus that generates a second signal. In addition, a null control signal can be generated based on an imaging signal. The first and second signals are processed, based on the null control signal, to generate a right beamformed audio signal having a first directional pattern with at least one first null, and a left beamformed audio signal having a second directional pattern with at least one second null. As used herein, the term "null" refers to a portion of a beamform where the magnitude is near-zero. Theoretically, a null exhibits no sensitivity to sound waves that emanate from angular directions incident on the angular location of the null. In reality, a perfect null with zero sensitivity is rarely (if ever) achieved, so an alternate definition of a null would be "a minimum portion or portions of a beamform with significant (e.g., 12 db) attenuation of the incoming signal". A first angular location ($\alpha$) of the at least one first null and a second angular location ($\beta$) of the at least one second null are steered based on the null control signal. As such the outputs of the microphones can be processed to create opposing, virtual microphones with beamforms that have steerable nulls. This way, the first and second directional patterns can remain diametrically opposed, but the angular locations of their respective nulls can be steered to a desired location for improved stereo imaging and/or for cancellation of an audio source at the rear-side of the electronic apparatus.

Figure 1A:
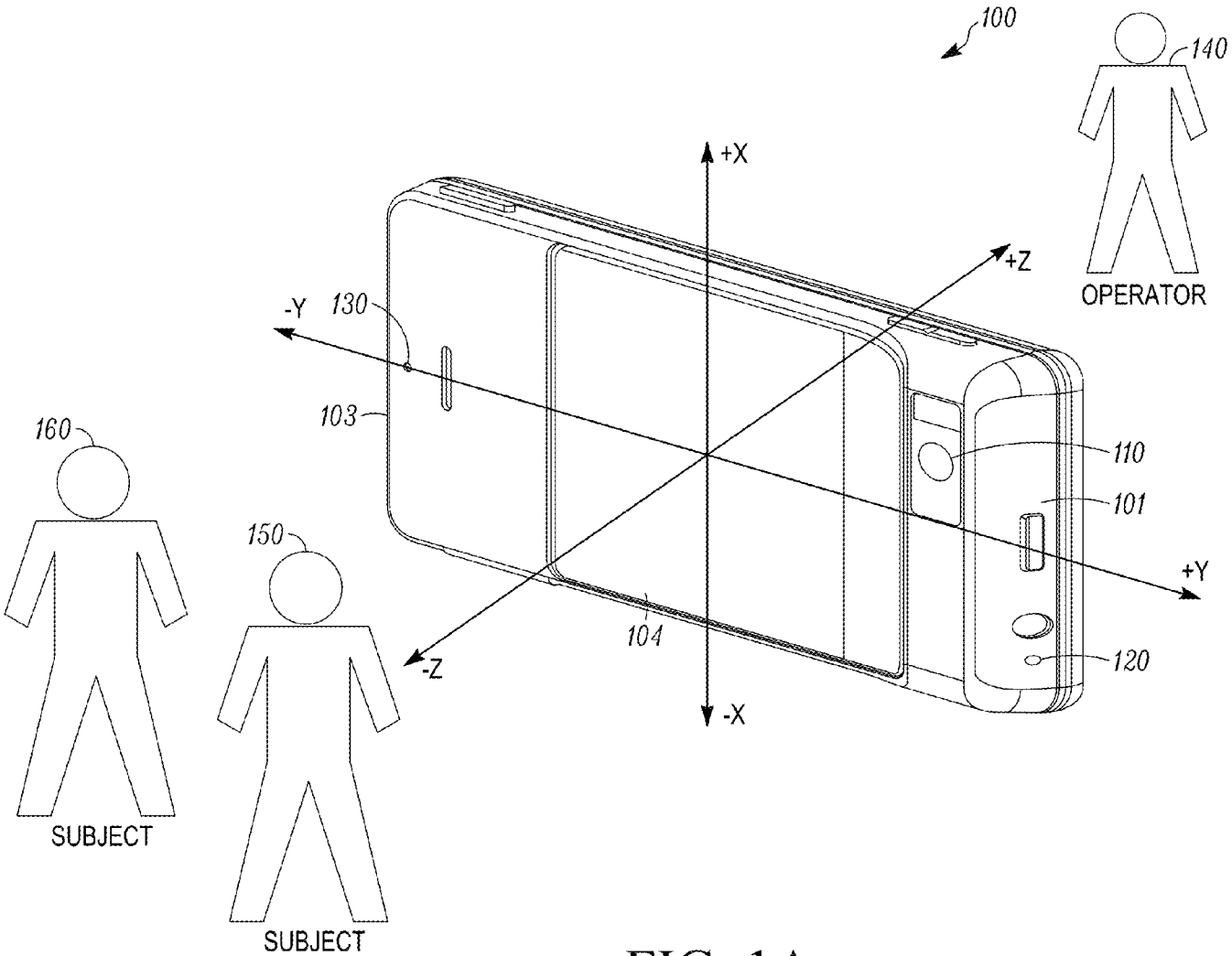
FIG. 1A is a front perspective view of an electronic apparatus in accordance with one exemplary implementation of the disclosed embodiments.
Figure 1B:
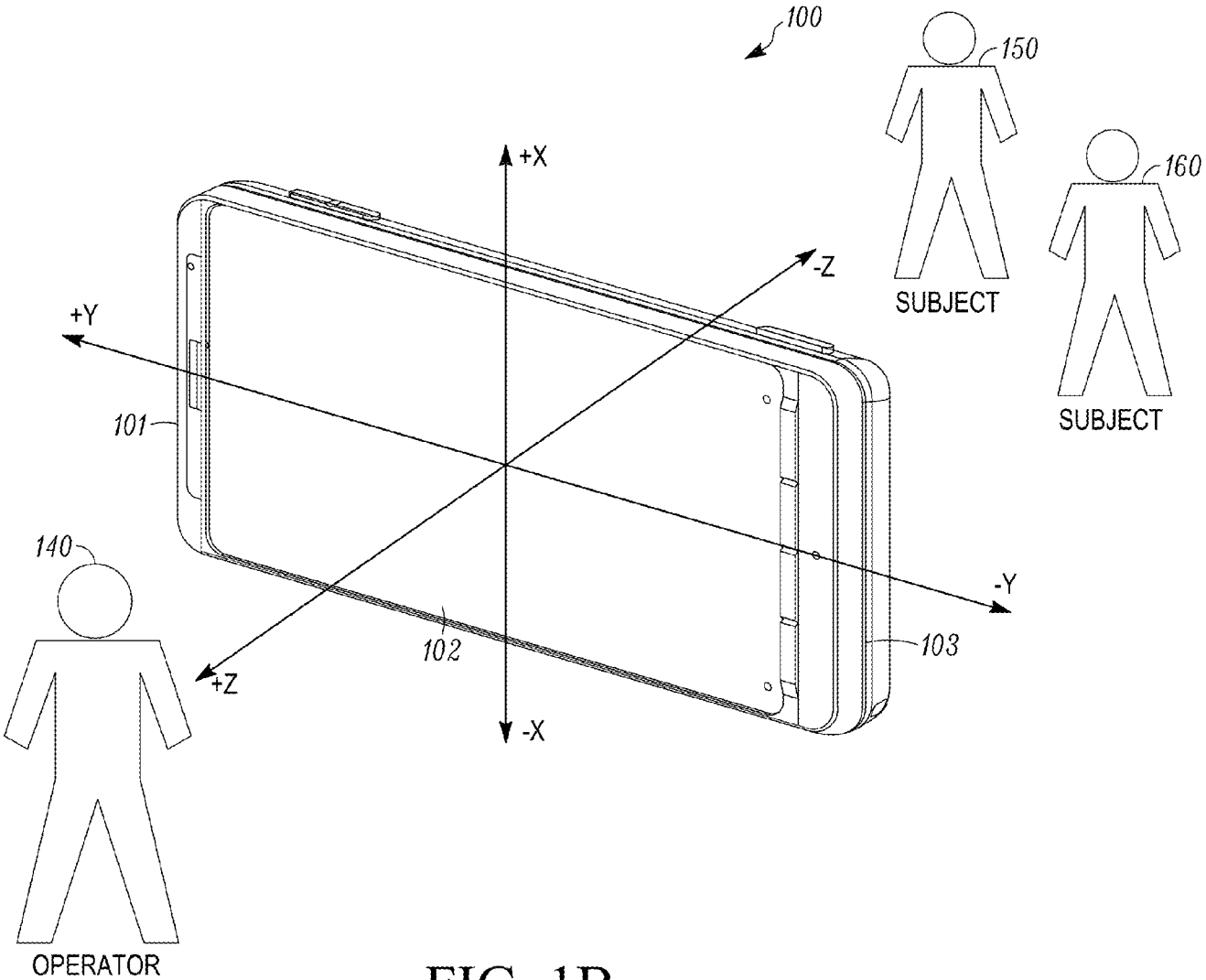
FIG. 1B is a rear perspective view of the electronic apparatus of FIG. 1A.
Figures 2A, 2B:
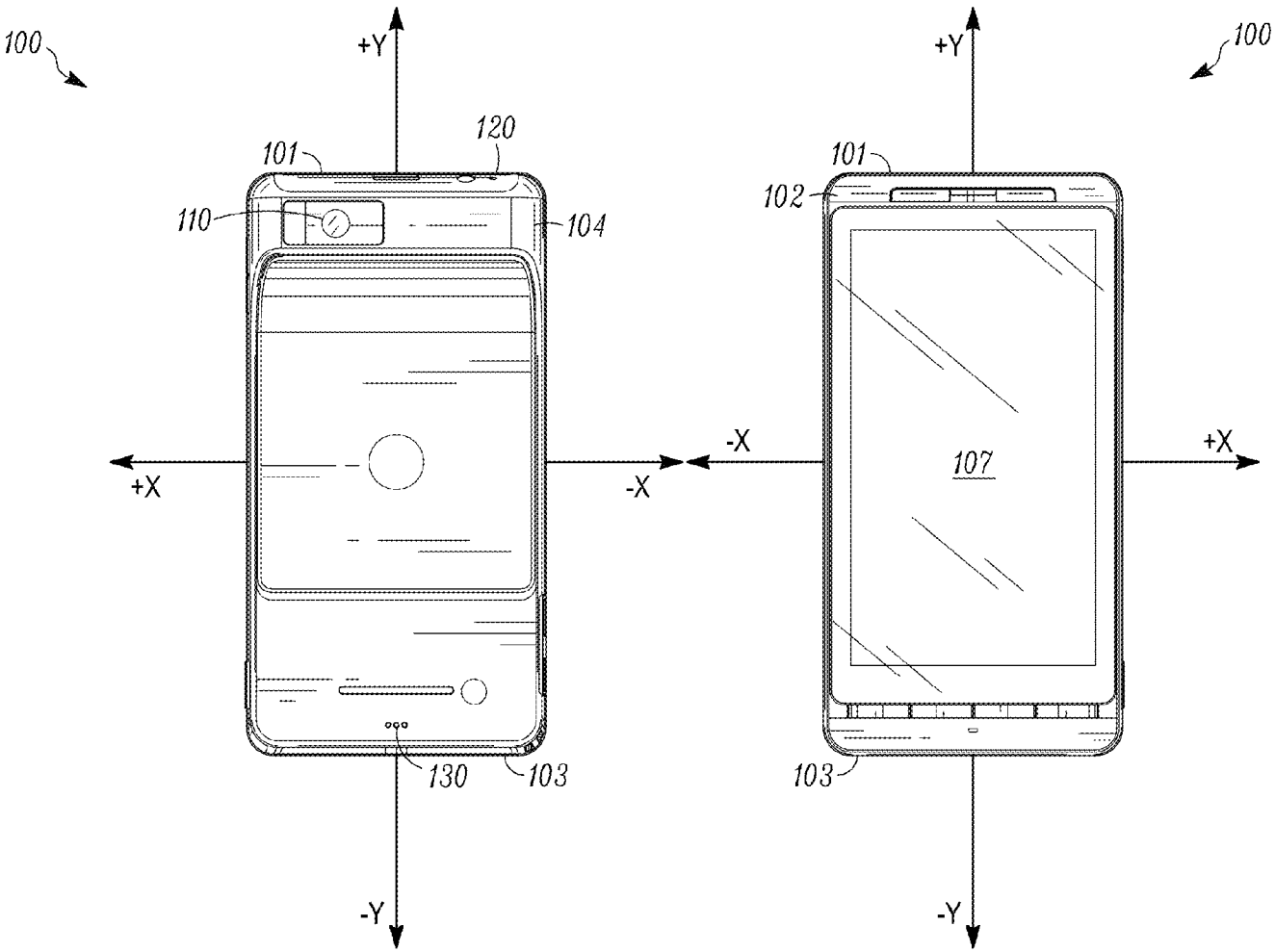
FIG. 2A is a front view of the electronic apparatus of FIG. 1A.
FIG. 2B is a rear view of the electronic apparatus of FIG. 1A.

Prior to describing the electronic apparatus with reference to FIGS. 3-10, one example of an electronic apparatus and an operating environment will be described with reference to FIGS. 1A-2B. FIG. 1A is a front perspective view of an electronic apparatus 100 in accordance with one exemplary implementation of the disclosed embodiments. FIG. 1B is a rear perspective view of the electronic apparatus 100. The perspective view in FIGS. 1A and 1B are illustrated with reference to an operator 140 of the electronic apparatus 100 that is recording one or more subjects 150, 160. FIG. 2A is a front view of the electronic apparatus 100 and FIG. 2B is a rear view of the electronic apparatus 100.

The electronic apparatus 100 can be any type of electronic apparatus having multimedia recording capability. For example, the electronic apparatus 100 can be any type of portable electronic device with audio/video recording capability including a camcorder, a still camera, a personal media recorder and player, or a portable wireless computing device. As used herein, the term "wireless computing device" refers to any portable computer or other hardware designed to communicate with an infrastructure device over an air interface through a wireless channel. A wireless computing device is "portable" and potentially mobile or "nomadic" meaning that the wireless computing device can physically move around, but at any given time may be mobile or stationary. A wireless computing device can be one of any of a number of types of mobile computing devices, which include without limitation, mobile stations (e.g. cellular telephone handsets, mobile radios, mobile computers, hand-held or laptop devices and personal computers, personal digital assistants (PDAs), or the like), access terminals, subscriber stations, user equipment, or any other devices configured to communicate via wireless communications.

The electronic apparatus 100 has a housing 102, 104, a left-side portion 101, and a right-side portion 103 opposite the left-side portion 101. The housing 102, 104 has a width dimension extending in a y-direction, a length dimension extending in an x-direction, and a thickness dimension extending in a z-direction (into and out of the page). The electronic apparatus 100 has a front-side (illustrated in FIG. 2A) and a rear-side (illustrated in FIG. 2B) oriented in opposite directions along a first axis. The rear-side is oriented in a +z-direction and the front-side oriented in a −z-direction. The left-side portion 101 and the right-side portion 103 are oriented in opposite directions along a y-axis that is perpendicular to the z-axis. Of course, as the electronic apparatus is re-oriented, the designations of "right", "left", "width", and "length" may be changed. The current designations are given for the sake of convenience.

More specifically, the housing includes a rear housing 102 on the operator-side or rear-side of the apparatus 100, and a front housing 104 on the subject-side or front-side of the apparatus 100. The rear housing 102 and front housing 104 are assembled to form an enclosure for various components including a circuit board (not illustrated), a speaker (not illustrated), an antenna (not illustrated), a video camera 110, and a user interface including microphones 120, 130 that are coupled to the circuit board. Microphone 120 is located nearer the left-side 101, and microphone 130 is located nearer the right-side 103.

The housing includes a plurality of ports for the video camera 110 and the microphones 120, 130. Specifically, the front housing 104 has ports for the front-side video camera 110 and other ports for the front-side microphones 120, 130. The microphones 120, 130 are disposed at/near these ports, and in some implementations the y-axis goes through the two microphone port openings.

The video camera 110 is positioned on the front-side and thus oriented in the same direction as the front housing 104, opposite the operator, to allow for images of the subject(s) to be acquired or captured during recording by the video camera 110.

The left-side portion 101 is defined by and shared between the rear housing 102 and the front housing 104, and oriented in a +y-direction that is substantially perpendicular with respect to the rear housing 102 and the front housing 104. The right-side portion 103 is opposite the left-side portion 101, and is defined by and shared between the rear housing 102 and the front housing 104. The right-side portion 103 is oriented in a −y-direction that is substantially perpendicular with respect to the rear housing 102 and the front housing 104.

Figure 3:
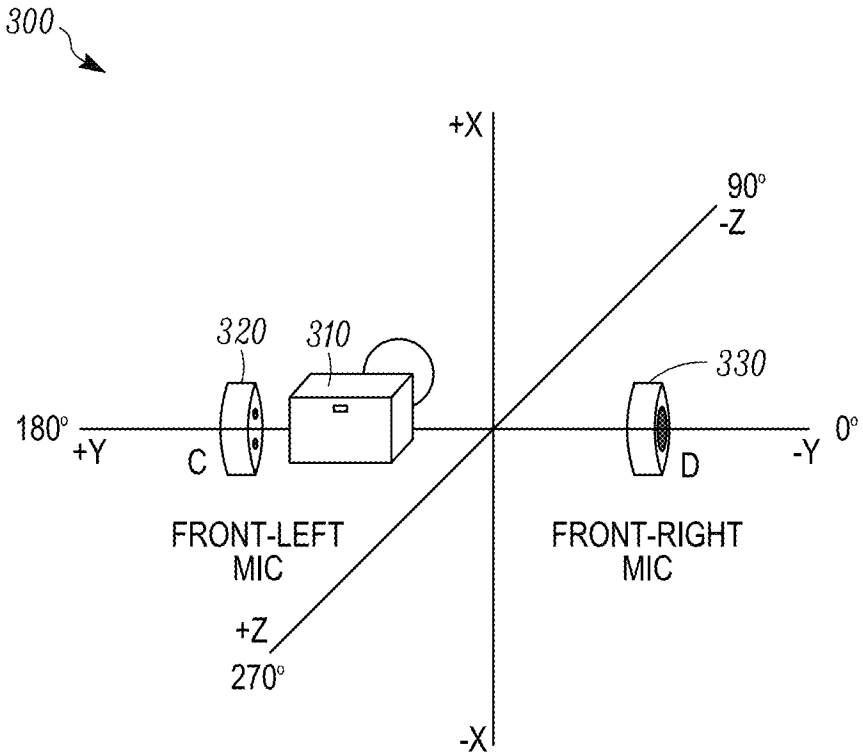
FIG. 3 is a schematic of a microphone and video camera configuration of an electronic apparatus in accordance with some of the disclosed embodiments.

FIG. 3 is a schematic of a microphone and video camera configuration 300 of the electronic apparatus in accordance with some of the disclosed embodiments. The configuration 300 is illustrated with reference to a Cartesian coordinate system and includes the relative locations of a left-side microphone 320 with respect to a right-side microphone 330 and video camera 310. Both physical microphone elements 320, 330 are shown on the subject or front-side of the electronic apparatus 100, but could reside on left and right sides 101, 103 respectively. The left-side microphone 320 is disposed near the left-side of the electronic apparatus and the right-side microphone 330 is disposed near a right-side of the electronic apparatus 100. As described above, the video camera 310 is shown positioned on a front-side of the electronic apparatus 100 and disposed near the left-side of the electronic apparatus 100, but could be disposed anywhere on the front side of the electronic apparatus 100. Alternatively, the video camera 310 could be disposed on the rear-side of the electronic apparatus 100 or a second camera (not shown) could be disposed on the rear-side of the electronic apparatus 100 to capture images or video of the operator 140 of the electronic apparatus 100 (e.g., in a webcam configuration).

The left-side and right-side microphones 320, 330 are located or oriented opposite each other along a common y-axis, which is oriented along a line at zero and 180 degrees. The z-axis is oriented along a line at 90 and 270 degrees and the x-axis is oriented perpendicular to the y-axis and the z-axis in an upward direction. The left-side and right-side microphones 320, 330 are separated by 180 degrees along the y-axis or diametrically opposed with respect to each other. The camera 310 is also located along the y-axis and points into the page in the −z-direction towards the subject(s) who are located in front of the apparatus 100. This way the left-side and right-side microphones 320, 330 are oriented such that they can capture audio signals or sound from the operator taking the video and as well as from the subjects being recorded by the video camera 310.

The left-side and right-side microphones 320, 330 can be any known type of microphone elements including omnidirectional microphones and directional microphones, pressure microphones, pressure gradient microphones or any other equivalent acoustic-to-electric transducer or sensor that converts sound into an electrical audio signal, etc. In one embodiment, where the left-side and right-side microphones 320, 330 are pressure microphone elements, they will have omnidirectional polar patterns that sense/capture incoming sound more or less equally from all directions. In one implementation, the left-side and right-side microphones 320, 330 can be part of a microphone array that is processed using beamforming techniques, such as delaying and summing (or delaying and differencing), to establish directional patterns based on electrical audio signals generated by the left-side and right-side microphones 320, 330. The delay can either be a phase delay distinct at every frequency implemented via a filter, or a fixed time delay. One example of delay and sum beamform processing will now be described with reference to FIG. 4.

Figure 4:
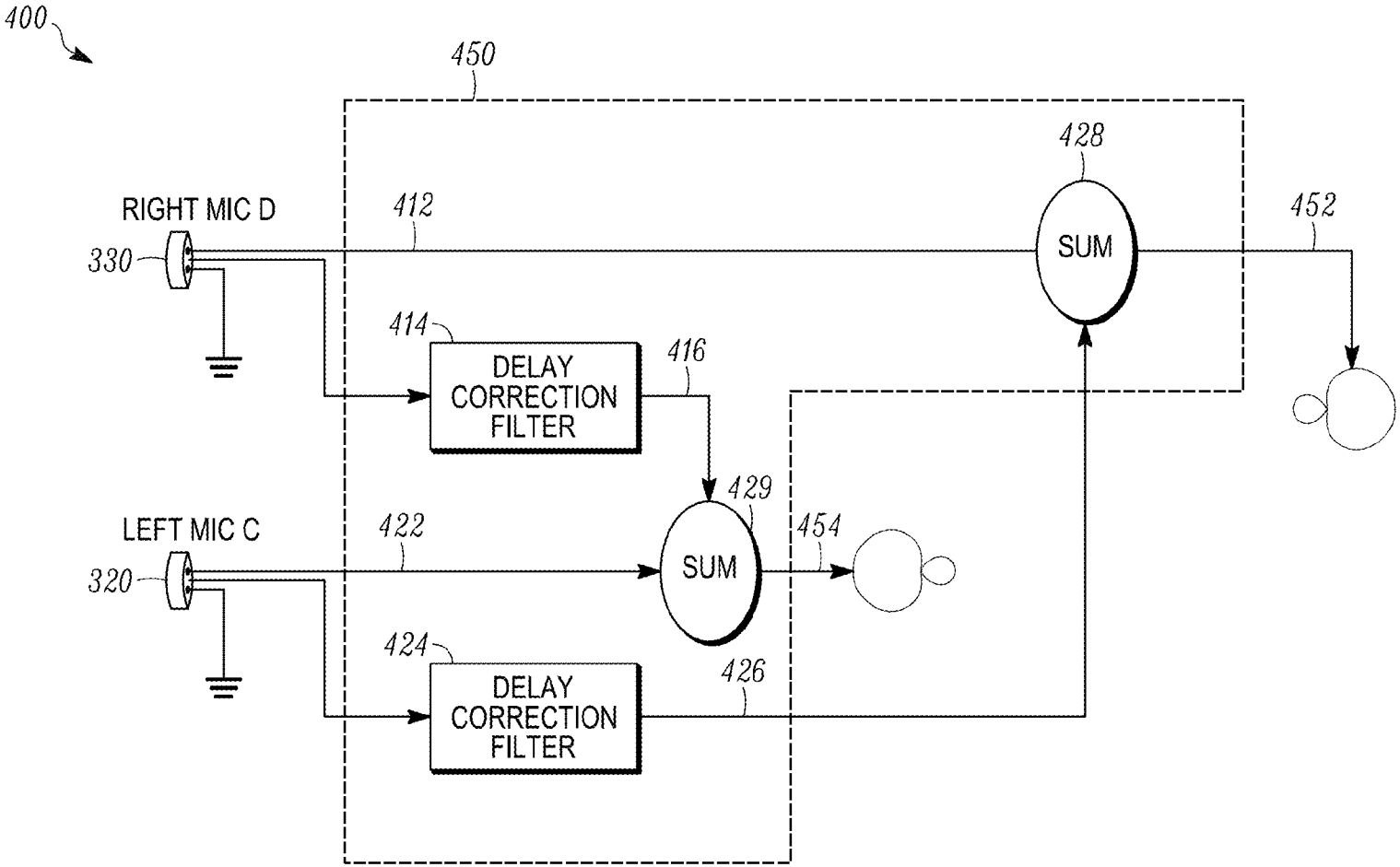
FIG. 4 is a block diagram of an exemplary system for delay and sum beamform processing of microphone output signals.

FIG. 4 is a block diagram of an exemplary system 400 for delay and sum beamform processing of microphone output signals 422, 412. Concepts illustrated in this system can be used in accordance with some of the disclosed embodiments.

The system 400 includes a microphone array that includes left and right microphones 320, 330 and a beamformer module 450. Each of the microphones 330, 320 generates an electrical audio signal 412, 422 in response to incoming sound. These electrical audio signals 412, 422 are generally a voltage signal that corresponds to sound captured at the left and right microphones 330, 320.

The beamformer module 450 is designed to generate right and left beamformed signals 452, 454. In this embodiment, the beamformer module 450 includes a first correction filter 414, a second correction filter 424, a first summer module 428, and a second summer module 429.

The first correction filter 414 adds phase delay to the first electrical audio signal 412 to generate a first delayed signal 416, and the second correction filter 424 adds phase delay to the second electrical audio signal 422 to generate a second delayed signal 426. For instance, in one implementation, the correction filters 414, 424 add a phase delay to the corresponding electrical audio signals 412, 422 to generate the corresponding delayed signals 416, 426.

The first summer module 428 sums the first signal 412 and the second delayed signal 426 to generate a first beamformed signal 452. Similarly, the second summer module 429 sums the second signal 422 and the first delayed signal 416 to generate a second beamformed signal 454.

In one implementation illustrated in FIG. 4, the first beamformed signal 452 is a right-facing first-order directional signal (e.g., supercardioid or hypercardioid) that corresponds to a right channel stereo output with a beampattern that is oriented to the right-side or in the −y-direction. The second beamformed signal 454 is a left-facing first-order directional signal (e.g., supercardioid or hypercardioid) that corresponds to a left channel stereo output with a beampattern that is oriented to the left-side or in the +y-direction. The left channel stereo output is spatially distinct from the right channel stereo output.

Thus, in the embodiment of FIG. 4, the first beamformed signal 452 corresponds to a right-facing virtual directional microphone with a main lobe having a maximum located along the 0 degree axis, and the second beamformed signal 454 corresponds to a left-facing virtual directional microphone with a main lobe having a maximum located along the 180 degree axis.

Although each of the beamformed audio signals 452, 454 is shown as separate right and left output channels, in some embodiments, these signals 452, 454 can be combined into a single audio output data-stream that can be transmitted and/or recorded as a single file containing separate stereo coded signals, but do not necessarily have to be combined.

Although the beamformed signals 452, 454 shown in FIG. 4 are both beamformed first order hypercardioid directional beamform patterns that are either right-side-oriented or left-side-oriented, those skilled in the art will appreciate that the beamformed signals 452, 454 are not necessarily limited to having these particular types of first order hypercardioid directional patterns and that they are shown to illustrate one exemplary implementation. In other words, although the directional patterns are hypercardioid-shaped, this does not necessarily imply the beamformed signals are limited to having a hypercardioid shape, and may have any other shape that is associated with first order directional beamform patterns such as a cardioid, dipole, supercardioid, etc. Alternatively a higher order directional beamform could be used in place of the first order directional beamform. Moreover, although the beamformed signals 452, 454 are illustrated as having hypercardioid directional patterns, it will be appreciated by those skilled in the art, that these are mathematically ideal examples only and that, in some practical implementations, these idealized beamform patterns will not necessarily be achieved.

As will be appreciated by those skilled in the art, the first order beamforms are those which follow the form A+B cos (θ) in their directional characteristics. To explain further, all first order directional microphones have a polar response described by equation (1):

$$(A+B\cos\theta)/(A+B) \quad (1),$$

where A is a constant that represents the omnidirectional component of the directional pattern of the beamformed signal, where B is a constant that represents the bidirectional component of the directional pattern of the beamformed signal, and where θ is the angle of incidence of the acoustic wave. Using the omnidirectional and bidirectional elements, any first order element can be created oriented along the axis of the bidirectional element. The directional patterns that can be produced by beamforming can range from a nearly cardioid beamform to a nearly bidirectional beamform, or from a nearly cardioid beamform to a nearly omnidirectional beamform. For an omnidirectional microphone B is 0; and for a bidirectional microphone A is zero. Other well known configurations are a cardioid where A=B=1; a hypercardioid where A=1, B=3, and a supercardioid where A=0.37, B=0.63.

In general, first order directional patterns where A<B result in patterns with higher directivity, and two nulls symmetric about the axis of the microphone wherein the axis of the microphone is defined as the angle of the peak of the main lobe of the beampattern through its 180-degree opposite. When the A=B the nulls are collocated as one single null which is at an angle of 0 degrees to the axis (and opposite the peak). The larger B is than A, the closer the angle gets to +/−90 degrees off the axis of the microphone (and opposite the peak). This will be described in more detail later.

A linear combination of properly phased omnidirectional and bidirectional microphone signals will produce the desired first order directional microphone pattern. Omnidirectional and bidirectional elements can be extracted by simple weighted addition and subtraction. For example, a virtual cardioid microphone with its lobe pointed to the right would be equals parts omnidirectional and bidirectional added together. A virtual cardioid microphone pointed in the opposite direction would be the difference between equal parts omnidirectional and bidirectional. For instance, opposing cardioids would have A=B for one direction and A=−B for the other. So the sum of signals from opposing cardioids would be an omnidirectional signal of twice the maximum amplitude of the individual cardioids, and the difference of the signals would be a bidirectional of twice the maximum amplitude of the individual cardioids.

Figure 5:
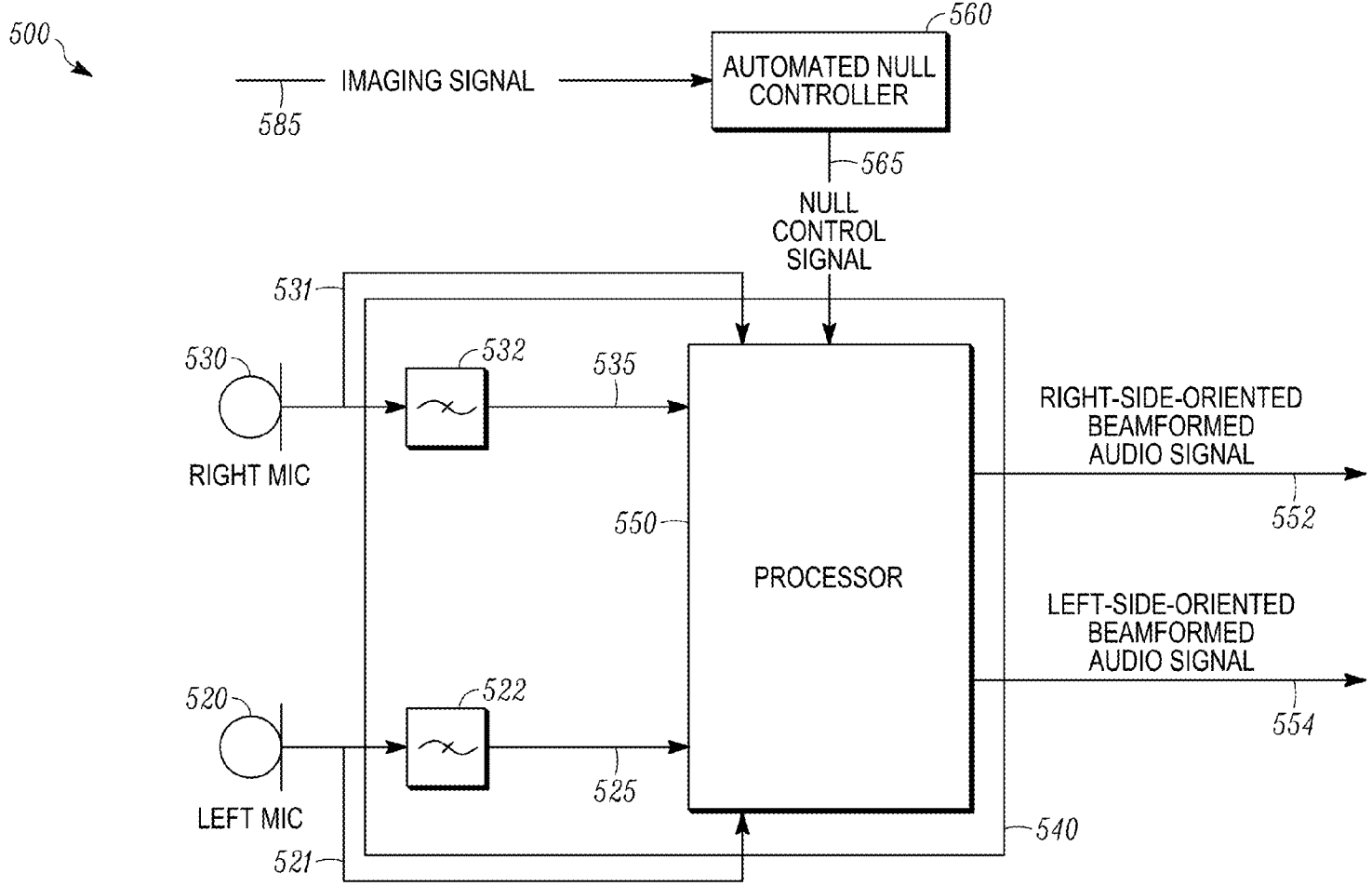
FIG. 5 is a block diagram of an audio processing system of an electronic apparatus in accordance with some of the disclosed embodiments.

FIG. 5 is a block diagram of an audio processing system 500 of an electronic apparatus 100 in accordance with some of the disclosed embodiments. The audio processing system 500 includes a microphone array that includes a first or left microphone 520 that generates a first signal 521 in response to incoming sound, and a second or right microphone 530 that generates a second signal 531 in response to the incoming sound. These electrical signals are generally a voltage signal that corresponds to a sound pressure captured at the microphones.

A first filtering module 522 is designed to filter the first signal 521 to generate a first phase-delayed audio signal 525 (e.g., a phase delayed version of the first signal 521), and a second filtering module 532 is designed to filter the second signal 531 to generate a second phase-delayed audio signal 535. Although the first filtering module 522 and the second filtering module 532 are illustrated as being separate from processor 550, it is noted that in other implementations the first filtering module 522 and the second filtering module 532 can be implemented within the processor 550 as indicated by the dashed-line rectangle 540.

The automated null controller 560 generates a null control signal 565 based on an imaging signal 585. Depending on the implementation, the imaging signal 585 can be provided from any one of number of different sources, as will be described in greater detail below. The sources that can provide the imaging signal can include a video camera, a controller for the video camera, or proximity sensors.

The processor 550 is coupled to the first microphone 520, the second microphone 530, and the automated null controller 560, and receives a plurality of input signals including the first signal 521, the first phase-delayed audio signal 525, the second signal 531, the second phase-delayed audio signal 535, and the null control signal 565.

The processor 550 performs beamform processing. The beamform processing performed by the processor 550 can generally include delay and sum processing (as described above with reference to FIG. 4, for example), delay and difference processing, or any other known beamform processing technique for generating directional patterns based on microphone input signals. Techniques for generating such first order beamforms are well-known in the art, and will not be described further herein.

In accordance with the disclosed embodiments, the null control signal 565 can be used by the processor 550 to control or steer nulls of the right-side-oriented beamformed audio signal 552 and the left-side-oriented beamformed audio signal 554 during beamform processing.

In one implementation, the processor 550 processes the input signals 521, 525, 531, 535, based on the null control signal 565, to generate a right (or "right-side-oriented") beamformed audio signal 552 that has a first directional pattern having at least one "first" null, and a left (or "left-side-oriented") beamformed audio signal 554 that has a second directional pattern having at least one "second" null, where a first angular location (α) of the at least one first null and a second angular location (β) of the at least one second null is steered based on the null control signal 565. The first angular location (α) is at a first angle with respect to the +y-axis, and the second angular location (β) is at a second angle with respect to the −y-axis. Depending on the implementation, the values of the first and second angular locations can be the same or different. The directional patterns can be first-order directional patterns as described above with reference to FIG. 4. As will be described below, during beamform processing, the null control signal 565 can be used to control or "steer" the first angular location (α) of the first null of the right-side-oriented beamformed audio signal 552 and the second angular location (β) of the second null of the left-side-oriented beamformed audio signal 554. As will be explained further below, this allows for control of the sensitivity of subject-oriented virtual microphones as well as for steering of the nulls of those virtual microphones.

Depending on the implementation, as will be described below with reference to FIGS. 6-9C, the nulls of the beamformed audio signals 552, 554 may include more than one null point. For instance, in one implementation, the right beamformed audio signal 552 can include a first null point oriented towards the front-side 104 at an angular location +α and a second null point oriented toward the rear-side 102 at an angular location −α, and the left beamformed audio signal 554 can include a third null point oriented towards the front-side 104 at an angular location +β and a fourth null point oriented toward the rear-side 102 at an angular location −β, respectively.

In one implementation, the processor 550 can include a look up table (LUT) that receives the input signals and the null control signal 565, and generates the right beamformed audio signal 552 and the left beamformed audio signal 554. The LUT is table of values that generates different signals 552, 554 depending on the value of the null control signal 565.

In another implementation, the processor 550 is designed to process a set of equations based on the input signals 521, 525, 531, 535 and the null control signal 565 to generate the right beamformed audio signal 552 and the left beamformed audio signal 554. The equations include coefficients for the first signal 521, the first phase-delayed audio signal 525, the second signal 531, and the second phase-delayed audio signal 535; and the values of these coefficients can be adjusted or controlled based on the null control signal 565 to generate the right beamformed audio signal 552 and/or the left beamformed audio signal 554 with nulls steered to the desired angular locations ($+\alpha$, $-\alpha$, $+\beta$, $-\beta$).

Examples of imaging signals 585 that can be used to generate the null control signal 565 will now be described in greater detail for various implementations.

Null Control Signal and Examples of Imaging Signals that can be Used to Generate the Null Control Signal The imaging signal 585 used to determine or generate the null control signal 565, can vary depending on the implementation. For instance, in some embodiments, the automated null controller 560 can be coupled to the video camera 310 that provides the imaging signal 585. In other embodiments, the automated null controller 560 is coupled to a video controller that is coupled to the video camera 310 and provides the imaging signal 585 to the automated null controller 560. The imaging signal 585 that is used by the automated null controller 560 to generate the null control signal 565 can be (or can be determined based on) one or more of (a) an angular field of view of a video frame of the video camera 310, (b) a focal distance for the video camera 310, or (c) a zoom control signal for the video camera 310. Any of these parameters can be used alone or in combination with the others to generate a null control signal 565. The video controller that generates the imaging signal 585 can be implemented in hardware or software. It may be an automated controller or one driven by user input such as a button, slider, navigation control, any other touch controller, or a graphical user interface (GUI).

Focal Distance-Based Null Control Signals

In one embodiment, the imaging signal 585 is based on focal distance for the video camera 310. For instance, in one implementation, focal distance information from the camera 310 to the subjects 150, 160 can be obtained from the camera 310, a video controller for the video camera 310, or any other distance determination circuitry in the device. In some implementations, focal distance of the video camera 310 can be used by the automated null controller 560 to generate the null control signal 565. In one implementation, the null control signal 565 can be a calculated focal distance of the video camera 110 that is sent to the automated null controller 560 by a video controller. The first angular location ($\alpha$) and the second angular location ($\beta$) increase relative to the y-axis as the focal distance is increased. The first angular location ($\alpha$) and the second angular location ($\beta$) decrease relative to the y-axis as the focal distance is decreased.

In one implementation, the first angular location ($\alpha$) and the second angular location ($\beta$) can be determined from a lookup table for a particular value of the focal distance. In another implementation, the first angular location ($\alpha$) and the second angular location ($\beta$) can be determined from a function relating the focal distance to the null angles.

Field of View-Based Null Control Signals

In another embodiment, the imaging signal 585 can be based on an angular field of view (FOV) of a video frame of the video camera 310. For instance, in some implementations, the angular field of view of the video frame of the video camera 310 can be calculated and sent to the automated null controller 560, which can then use that information to generate the null control signal 565. The first angular location ($\alpha$) and the second angular location ($\beta$) increase relative to the y-axis as the angular field of view is narrowed or decreased. The first angular location ($\alpha$) and the second angular location ($\beta$) decrease relative to the y-axis as the angular field of view is widened or increased.

In one implementation, the first angular location ($\alpha$) and the second angular location ($\beta$) can be determined from a lookup table for a particular value of the field of view. In another implementation, the first angular location ($\alpha$) and the second angular location ($\beta$) can be determined from a function relating the field of view to the null angles.

Zoom Control-Based Null Control Signals

In other embodiments, the imaging signal 585 is based on a zoom control signal for the video camera 310. In one embodiment, the physical video zoom of the video camera 310 is used to generate the null control signal 565. In these embodiments, a narrow zoom can also be called a high zoom value, whereas a wide zoom can also be called a low zoom value. As the zoom control signal is increased to narrow the angular field of view, this will cause the first angular location ($\alpha$) and the second angular location ($\beta$) to increase relative to the y-axis which goes through the left and right microphones 320, 330. By contrast, as the zoom control signal is decreased to widen or expand the angular field of view, this will cause the first angular location ($\alpha$) and the second angular location ($\beta$) to decrease relative to the y-axis which goes through the left and right microphones 320, 330.

In some embodiments, the null control signal 565 can be a zoom control signal for the video camera 310, whereas in other embodiments the null control signal 565 can be derived based on a zoom control signal for the video camera 310. In some implementations, the zoom control signal for the video camera 310 can be a digital zoom control signal that controls an apparent angle of view of the video camera, whereas in other implementations the zoom control signal for the video camera 310 can be an optical/analog zoom control signal that controls position of lenses in the camera. In one implementation, preset null angle values can be assigned for particular values (or ranges of values) of the zoom control signal.

In some embodiments, the zoom control signal for the video camera can be controlled by a user interface (UI). Any known video zoom UI methodology can be used to generate a zoom control signal. For example, in some embodiments, the video zoom can be controlled by the operator via a pair of buttons, a rocker control, virtual controls on the display of the device including a dragged selection of an area, by eye tracking of the operator, etc.

In one implementation, the first angular location ($\alpha$) and the second angular location ($\beta$) can be determined from a lookup table for a particular value of the zoom control signal. In another implementation, the first angular location ($\alpha$) and the second angular location ($\beta$) can be determined from a function relating the value of a zoom control signal to field of view.

Additionally these embodiments allow for a stereo image to zoom in or out in accordance with a video image zooming in or out.

Proximity-Based Null Control Signals

In some embodiments, when the electronic apparatus 100 includes proximity sensor(s) (infrared, ultrasonic, etc.), proximity detection circuits, and/or other types of distance measurement device(s) (not shown), the imaging signal 585 can include proximity information generated by the proximity detector or sensor. For example, in some embodiments, the apparatus 100 can include a rear-side proximity sensor that is coupled to the automated null controller 560. The rear-side proximity sensor generates a rear-side proximity sensor signal that corresponds to a distance between the camera operator 140 and the apparatus 100. The rear-side proximity sensor signal can then be sent to the automated null controller 560, which can use the rear-side proximity sensor signal to generate the null control signal 565.

In one embodiment, the rear-side proximity sensor signal corresponds to a distance between the camera operator 140 and the apparatus 100. Depending on the implementation, the rear-side proximity sensor signal can be based on estimated, measured, or sensed distance between the camera operator 140 and the electronic apparatus 100.

In another embodiment, the rear-side proximity sensor signal corresponds to a predetermined distance between the camera operator 140 and the apparatus 100. For instance, in one implementation, the predetermined distance can be set as a fixed distance at which an operator of the camera 110 is normally located (e.g., based on an average human holding the device in a predicted usage mode). In such an embodiment, the automated null controller 560 presumes that the camera operator is a predetermined distance away from the apparatus and generates a null control signal 565 to reflect that predetermined distance.

In yet another embodiment, the rear-side proximity sensor signal corresponds to a distance between the camera operator and the apparatus 100, and the second null point (of the right beamformed audio signal 552) and the fourth null point (of the left beamformed audio signal 554) are oriented to cancel sound that originates from the rear-side at the distance. As will be described further below with reference to FIG. 7, this allows the coverage angle of the nulls to be oriented such that a sound source behind the apparatus 100 (e.g., such as the operator) can be suppressed.

Figure 6:
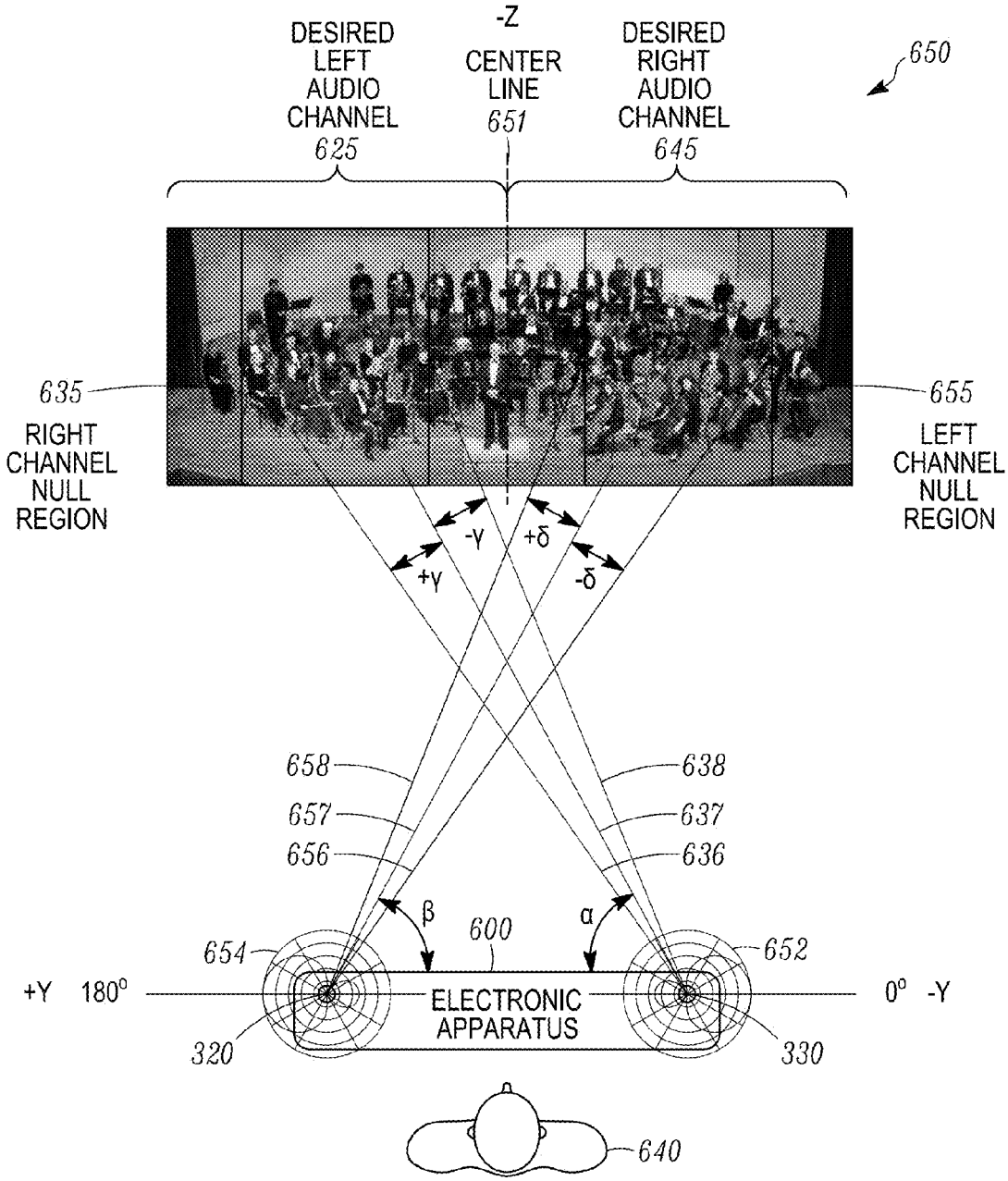
FIG. 6 is a diagram that illustrates an exemplary polar graph of a right beamformed audio signal and an exemplary polar graph of a left beamformed audio signal with respect to an electronic apparatus and an angular field of view being acquired in accordance with one implementation of some of the disclosed embodiments.

An example of how the angular locations α, β of the nulls relate to a video frame or angular field of view being acquired will now be provided with reference to FIG. 6.

Steering Angular Location of Front-Side Nulls to Control Stereo Imaging of Subject(s) being Acquired FIG. 6 is a diagram that illustrates an exemplary polar graph of a right beamformed audio signal 652 and an exemplary polar graph of a left beamformed audio signal 654 with respect to an electronic apparatus 600 and an angular field of view being acquired in accordance with one implementation of some of the disclosed embodiments. In FIG. 6, the electronic apparatus 600 is not drawn to scale, and is exaggerated in size to illustrate its relationship to a field of view 650 being acquired or recorded by a video camera (not shown) of the electronic apparatus 600. In most implementations, the field of view 650 being acquired or recorded by the video camera (not shown) is much larger than the apparatus 600 such that the apparatus is effectively a point receptor with respect to the field of view 650. For example, in FIG. 6, where an orchestra is being recorded, the desired recording would be for (a) the audio from the right side of the stage to be recorded on the right channel, (b) the audio from the left side of the stage recorded to the left channel, and (c) to have objects in the middle appear on both channels to give a center audio image for those objects.

Output signals 521, 531 generated by the physical microphones 520, 530 are processed using the beamforming techniques described above to generate the right beamformed audio signal 652 that has a first super-cardioid directional pattern that is oriented to the right in the direction of the −y-axis, and the left beamformed audio signal 654 that has a second super-cardioid directional pattern that is oriented to the left in the direction of the +y-axis. The major lobes of the first super-cardioid directional pattern and the second super-cardioid directional pattern are oriented diametrically opposite each other to the right and left, respectively. Further details regarding the 654 and 652 will be described below with reference to FIGS. 8A and 8B, respectively.

The field of view 650 of the video frame is split into a left-side portion and a right-side portion via a center line 651. The left-side portion contributes to a desired left audio image 625, and the right-side portion contributes to a desired right audio image 645. The first super-cardioid directional pattern of the right beamformed audio signal 652 produces a right channel null region 635, and the second super-cardioid directional pattern of the left beamformed audio signal 654 produces a left channel null region 655.

To explain further, the desired left audio image 625 overlaps the right channel null region 635 (as illustrated by a rectangular shaded region) that is associated with the right beamformed audio signal 652 but does not include the left channel null region 655 (as illustrated by a rectangular shaded region), and the desired right audio image 645 overlaps the left channel null region 655 that is associated with the left beamformed audio signal 654 but does not include the right channel null region 635. In addition, the first angular location (α) of the first null is defined between two null lines 636, 638 that diverge from a common origin to define a right channel null region 635. A first null center line 637 is defined between the null region boundaries 636, 638, and has a first angular location (α) with respect to the +y-axis. The right channel null region 635 is a null region that is centered around the first null center line 637 and bounded by the null region boundaries 636, 638. The angle that the null region 635 spans is a first number of degrees equal to 2γ. As used herein, the term "null center line" refers to a line going through a null of a beamform at a point where the magnitude of the beamform is at its minimum. As the first angular location (α) changes, the angle of the two null region boundaries 636, 638 also changes along with the right channel null region 635. Similarly, the second angular location (β) of the second null is defined between two null region boundaries 656, 658 that diverge from a common origin to define a left channel null region 655. The left channel null region 655 also spans a second number of degrees equal to 2δ, which may be equal to the first number of degrees 2γ. A null center line 657 is defined between the null region boundaries 656, 658, and has the second angular location (β) with respect to the −y-axis. The left channel null region 655 is a null region that is centered around the second null center line 657. As the second angular location (β) changes, the angle of the two null region boundaries 656, 658 also changes along with the left channel null region 655.

Thus, with respect to the first angular location (α), the right channel null region 635 is illustrated as covering a portion of the field of view 650 that is ±γ degrees with respect to α, and the second angular location (β) of the left channel null region 655 is illustrated as covering another portion of the field of view 650 that is ±δ degrees with respect to β. In the particular implementation illustrated in FIG. 6, each channel's null regions are located approximately three-quarters of the way across the image field from a desired edge of field for that channel, and at approximately the center of the opposite side of the field being acquired.

The directional pattern of the right beamformed audio signal 652 will have stronger sensitivity to sound waves originating from the region that corresponds to the desired right audio image 645, but significantly lessened sensitivity to sound waves originating from the region that corresponds to the desired left audio image 625. The right channel null region 635 coincides with the desired left audio image 625 and allows some of sound originating from the desired left audio image 625 to be reduced. As such, the virtual microphone corresponding to the right beamformed audio signal 652 can be used to acquire/record a desired right audio image 645, with minimal signal being acquired from the left audio image 625 due to the right channel null region 635.

In this specific non-limiting implementation, the right channel null of the beamform is centered on the left side of the stage. The signal that will be recorded on the right channel will include a full audio level for the subjects furthest to the right, with a general decline in audio level moving towards center, and with a significant suppression of the audio at the center of the left side of the stage where the shaded rectangle is shown.

Similarly, the directional pattern of the left beamformed audio signal 654 will have stronger sensitivity to sound waves originating from the region that corresponds to the desired left audio image 625, but significantly lessened sensitivity to sound waves originating from the region that corresponds to the desired right audio image 645. The left channel null region 655 coincides with the desired right audio image 645 and allows some of sound originating from the desired right audio image 645 to be reduced. As such, the virtual microphone corresponding to the left beamformed audio signal 654 can be used to acquire/record a desired left audio channel 625, with minimal signal being acquired from the right audio image 645 due to the left channel null region 655.

In this specific non-limiting implementation, the left channel null of the beamform is centered on the right-side. The signal that will be recorded on the left channel will include a full audio level for the subjects furthest to the left, with a general decline in audio level moving towards center, and with a significant suppression of the audio at the center of the right side of the stage where the shaded rectangle is shown.

The right beamformed audio signal 652 and the left beamformed audio signal 654 can ultimately be combined to produce a stereo signal with appropriate imaging contributions from the desired left audio channel 625 and the desired right audio channel 645 of the subject(s) being acquired.

As described above, the first angular location ($\alpha$) of the right channel null region 635 and the second angular location ($\beta$) of the left channel null region 655 can be steered based on the null control signal 565 during beamform processing. In other words, the null control signal 565 can be used to control or "steer" the first angular location ($\alpha$) of the right channel null region 635 of the right-side-oriented beamformed audio signal 652 and the second angular location ($\beta$) of the left channel null region 655 of the left-side-oriented beamformed audio signal 654.

This allows the angular locations ($\alpha$, $\beta$) of the right channel null region 635 and the left channel null region 655 to be steered based on an angular field of view, a focal distance, or a zoom control signal, for example, to vary the stereo imaging and make the stereo signal coincide with the video frame that is being acquired/captured by the operator. The angles or angular locations ($\alpha$, $\beta$) of the right channel null region 635 and the left channel null region 655 can be steered to de-emphasize sound waves that originate from directions corresponding to different null regions with respect to the field of view 650 being acquired by the electronic apparatus 600. Thus, although the right channel null region 635 and the left channel null region 655 are aligned with the center of the opposite side of field of view 650 being acquired, the positions of the right channel null region 635 and the left channel null region 655 can be changed or controlled via the null control signal. For example, as the first angular location ($\alpha$) of the right channel null region 635 decreases (e.g., by decreasing a zoom control signal), the right channel null region 635 will move further away from the center line 651 and the audio field of view will widen.

Other characteristics of the left beamformed audio signal 654 and the right beamformed audio signal 652 will be described below with reference to FIGS. 8A and 8B, respectively.

Steering Angular Locations of Rear-Side Nulls to Cancel Rear-Side Sound Sources

Figure 7:
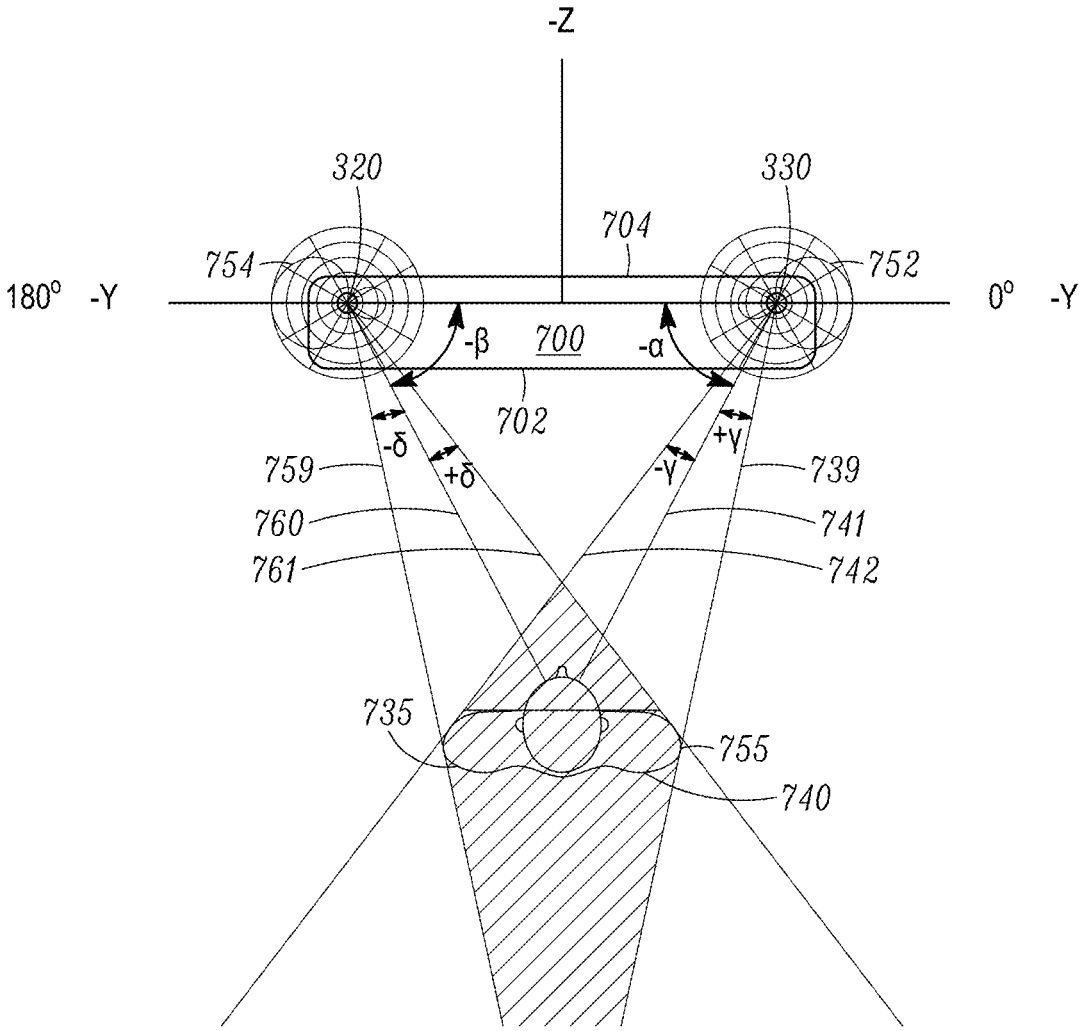
FIG. 7 is a diagram that illustrates an exemplary polar graph of a right beamformed audio signal and an exemplary polar graph of a left beamformed audio signal that are generated by an electronic apparatus in accordance with another implementation of some of the disclosed embodiments.

FIG. 7 is a diagram that illustrates an exemplary polar graph of a right beamformed audio signal 752 and an exemplary polar graph of a left beamformed audio signal 754 that are generated by an electronic apparatus 700 in accordance with another implementation of some of the disclosed embodiments.

This view differs from that in FIG. 6 in that it shows the angular locations ($-\alpha$, $-\beta$) of the right channel null region 735 and the left channel null region 755 with respect to an operator 740 of the electronic apparatus 700, where the angular locations ($-\alpha$, $-\beta$) of the right channel null region 735 and the left channel null region 755 of virtual microphones have been steered for cancellation of sound waves that originate from the rear-side of the electronic apparatus 700 (e.g., from the operator 740).

As described above, the nulls of the beamformed audio signals 752, 754 may include more than one null region. For instance, in one implementation, the right beamformed audio signal 752 can include a first null point (corresponding to line 737) oriented towards the front-side 704 and a second null point (corresponding to line 741) oriented toward the rear-side 702, and the left beamformed audio signal 754 can include a third null point (corresponding to line 757) oriented towards the front-side 704 and a fourth null point (corresponding to line 760) oriented toward the rear-side 702, respectively.

For example, in one implementation, a rear-side proximity sensor, coupled to the automated null controller, generates a rear-side proximity sensor signal that corresponds to a predetermined distance between a camera operator and the apparatus. The imaging signal is also based on the rear-side proximity sensor signal. For example, the nulls on the operator side of the apparatus 700 can be computed such that a ratio of A and B (in equation (1)) are selected such that the null from each side is pointed at the operator controlling the apparatus 700. This can be accomplished in a number of different non-limiting ways. For example, in one embodiment, the angle can be computed based on the average position that is it assumed the operator is going to be behind the device based on human factors studies or user testing. In another embodiment, the angle can be computed from half the distance between the microphones and the measured distance to the operator. The angle would be computed using a function such as ARCTAN ((micspacing/2)/distance).

In another implementation, a rear-side proximity sensor (not shown) can generate a rear-side proximity sensor signal that corresponds to a distance between a camera operator 740 and the apparatus 700. The automated null controller can use the rear-side proximity sensor signal to generate a null control signal such that the second null point (corresponding to line 741) and the fourth null point (corresponding to line 760) are steered such that they are oriented to cancel sound that originates from the rear-side 702 at the proximity-sensed distance of the operator thus reducing or canceling sound that originates from the camera operator 740 or other proximity-sensed rear-side sound source.

This also allows for the cancellation of sound arising from directly behind the recording device, such as sounds made by the operator. Rear-side cancellation is a separate mode and is not based on the optical frame being acquired.

Examples of beamformed signals generated by the processor 550 and null steering of those signals will be described below with reference to polar graphs illustrated in FIGS. 8A-9C. Preliminarily, it is noted that in any of the polar graphs described below, signal magnitudes are plotted linearly to show the directional or angular response of a particular signal. Further, in the examples that follow, for purposes of illustration of one example, it can be assumed that the subject is generally centered at approximately 90° while the operator is located at approximately 270°. The directional patterns shown in FIGS. 8A-9C are slices through the directional response forming a plane as would be observed by a viewer who, located above the electronic apparatus 100 of FIGS. 1A and 1B, is looking downward, where the z-axis in FIG. 3 corresponds to the 90°-270° line, and the y-axis in FIG. 3 corresponds to the 0°-180° line through the microphone port openings. As a person of ordinary skill is aware, the complete directional patterns are three-dimensional and planar slices are provided here for the sake of simplicity. Moreover, for sake of clarity in the polar graphs that are illustrated in FIGS. 8A-9C, a particular null region is represented here only by its corresponding null center line.

Figure 8A:
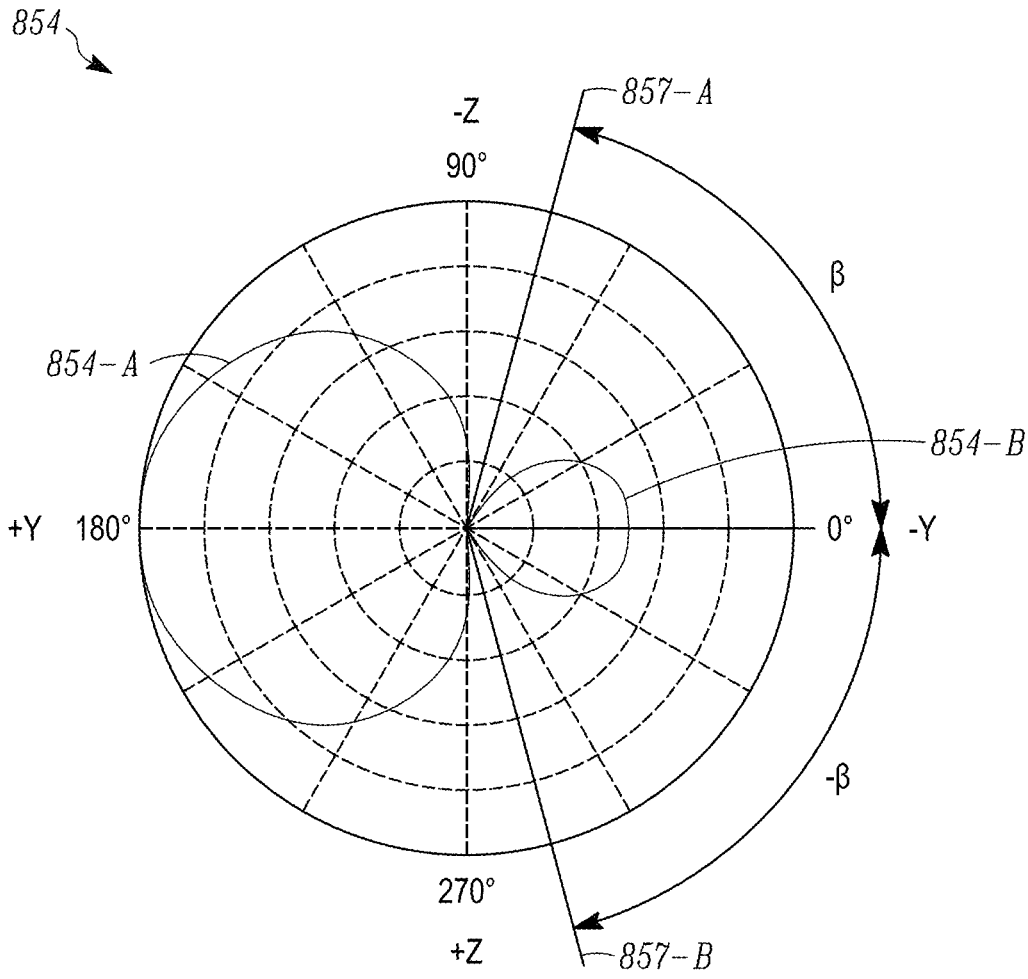
FIG. 8A is an exemplary polar graph of a left-side-oriented beamformed signal generated by the audio processing system in accordance with one implementation of some of the disclosed embodiments.

FIG. 8A is an exemplary polar graph of a left-side-oriented beamformed signal 854 generated by the audio processing system 500 in accordance with one implementation of some of the disclosed embodiments. The left-side-oriented beamformed signal 854 of FIG. 8A is representative of the left-side-oriented beamformed signals 654, 754 shown in FIGS. 6 and 7.

As illustrated in FIG. 8A, the left-side-oriented beamformed signal 854 has a first-order directional pattern that points or is oriented towards the +y-direction, and has a main lobe 854-A having a maximum at 180 degrees and a minor lobe 854-B that is oriented in the −y-direction. This directional pattern indicates that there is a stronger directional sensitivity to sound waves traveling towards the left-side of the apparatus 100. The left-side-oriented beamformed signal 854 also has a pair of nulls that are centered at null center lines 857-A, 857-B.

The null center line 857-A of one null points at an angular location (β) towards the front right-side of the apparatus 100 and corresponds to a front-left channel null region (see FIG. 6). The other null center line 857-B of the other null points at an angle or angular location (−β) towards the rear right-side of the apparatus 100 and corresponds to a rear-left channel null region (see FIG. 7). In this particular example, the angular location (β) of the null center line 857-A is at approximately 75 degrees with respect to the −y-axis, and the angular location (−β) of the null center line 857-B is at approximately −75 degrees with respect to the −y-axis.

Figure 8B:
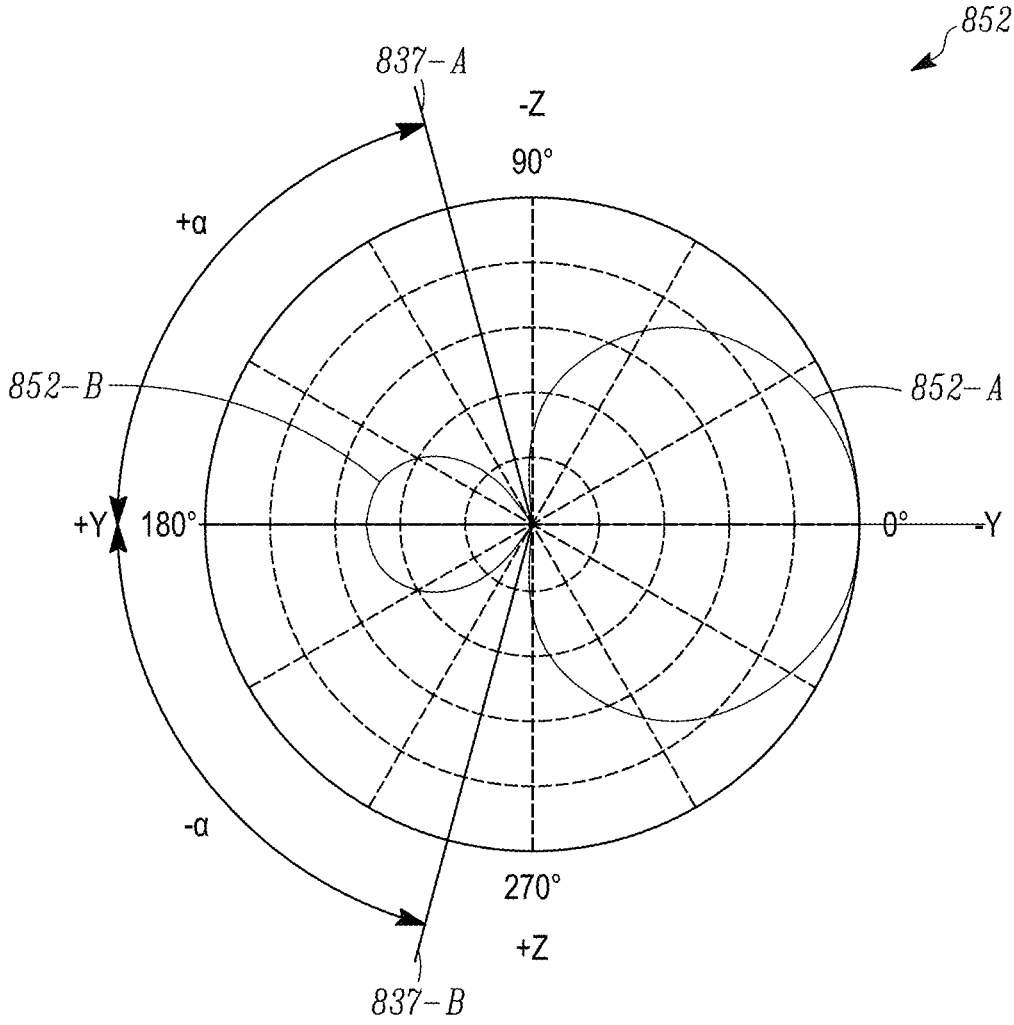
FIG. 8B is an exemplary polar graph of a right-side-oriented beamformed signal generated by the audio processing system in accordance with one implementation of some of the disclosed embodiments.

FIG. 8B is an exemplary polar graph of a right-side-oriented beamformed signal 852 generated by the audio processing system 500 in accordance with one implementation of some of the disclosed embodiments. The right-side-oriented beamformed signal 852 of FIG. 8B is representative of the right-side-oriented beamformed signals 652, 752 shown in FIGS. 6 and 7.

As illustrated in FIG. 8B, the right-side-oriented beamformed signal 852 has a first-order directional pattern that points or is oriented towards the right in the −y-direction, and has a main lobe 852-A having a maximum at zero degrees and a minor lobe 852-B that is oriented in the +y-direction. This directional pattern indicates that there is a stronger directional sensitivity to sound waves traveling towards the right-side of the apparatus 100. The right-side-oriented beamformed signal 852 also has a pair of nulls that are centered at null center lines 837-A, 837-B.

The null center line 837-A of one null points at an angular location (α) towards the front left-side of the apparatus 100 and corresponds to a front-right channel null region (see FIG. 6). The other null center line 837-B of the other null points at an angular location (−α) towards the rear left-side of the apparatus 100 and corresponds to a rear-right channel null region (see FIG. 7). In this particular example, the angular location (α) of the null center line 837-A is at approximately −75 degrees with respect to the +y-axis, and the angular location (−α) of the null center line 837-B is at approximately +75 degrees with respect to the +y-axis.

As described above with reference to FIG. 5, the automated null controller 560 generates a null control signal 565 that can be used by the processor 550 to control or steer nulls of the right-side-oriented beamformed audio signal 552 and the left-side-oriented beamformed audio signal 554 during beamform processing to change the angular locations of the nulls. For example, when the magnitude of the angular location (α) of the null center line 837-A increases, this has the effect of increasing a ratio of B:A in equation (1) described above, and when the magnitude of the angular location (α) of the null center line 837-A decreases this has the effect of decreasing a ratio of B:A in equation (1) described above.

As the recorded field of view goes from a wide (un-zoomed) angular field of view to a narrow (high-zoomed) angular field of view, the ratio of B/A in equation (1) that describes the first order beamform and the angular location a would increase. As the zoom value goes from a narrow (high-zoomed) angular field of view to a wide (un-zoomed) angular field of view, the ratio of B/A in equation (1) and angular location a would become smaller. One example will now be illustrated with reference to FIG. 8C.

Figure 8C:
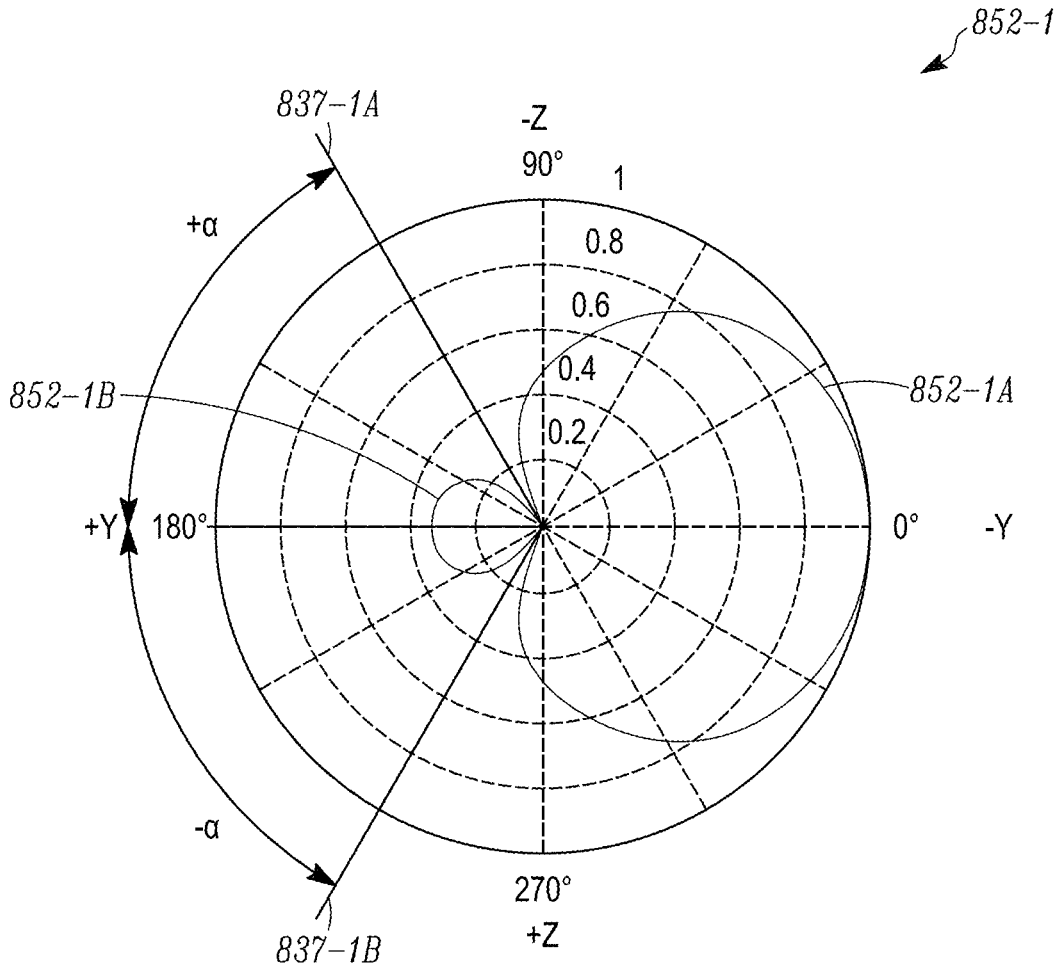
FIG. 8C is an exemplary polar graph of a right-side-oriented beamformed signal generated by the audio processing system in accordance with another implementation of some of the disclosed embodiments.

FIG. 8C is an exemplary polar graph of a right-side-oriented beamformed signal 852 generated by the audio processing system 500 in accordance with another implementation of some of the disclosed embodiments. As illustrated in FIG. 8C, the right-side-oriented beamformed signal 852 has a first-order directional pattern similar to that illustrated in FIG. 8B. However, in this implementation, an angular location of the nulls of the right-side-oriented beamformed signal 852 has changed. Specifically, the null center line 837-1A now has an angular location α of approximately −60 degrees with respect to the +y-axis, and the null center line 837-1B now has an angular location −α of approximately +60 degrees) with respect to the +y-axis. Thus, in comparison to FIG. 8B, the angular location of the nulls (as represented by their respective null center lines 837-1A, 837-1B) have been steered to point at different angular locations in FIG. 8C (even though the null center lines still remain oriented at angles towards the front left-side and the rear left-side of the apparatus 100, respectively, and the main lobe still has its maximum located at 0 degrees). As such, the relative locations of the front-right channel null region (not illustrated) and the rear-right channel null region (not illustrated) will also change the location of the right audio image further to the right. In addition, it is also noted that the magnitude of the main lobe 852-1A has increased relative to the magnitude of the minor lobe 852-1B resulting in the audio image shifting further to the right. As mentioned previously, the angular location of the main lobe 852-1A remains fixed at zero degrees.

Further details regarding the effects that can be achieved by implementing such null steering techniques will now be described below with reference to FIGS. 9A-9C.

Preliminarily, it is noted that although not illustrated in FIGS. 8A-8C, in some embodiments, the beamformed audio signals 852, 854 can be combined into a single audio output data stream that can be transmitted and/or recorded as a file containing separate stereo coded signals. FIGS. 9A-9C will illustrate some examples of such a combination by describing different examples of beamformed signals 552, 554 that can be generated by the processor 550 in different scenarios. In FIGS. 9A-9C, both the responses of a right-side-oriented beamformed audio signal 952 and a left-side-oriented beamformed audio signal 954 will be shown together to illustrate that the signals may be combined in some implementations to achieve stereo effect.

Figure 9A:
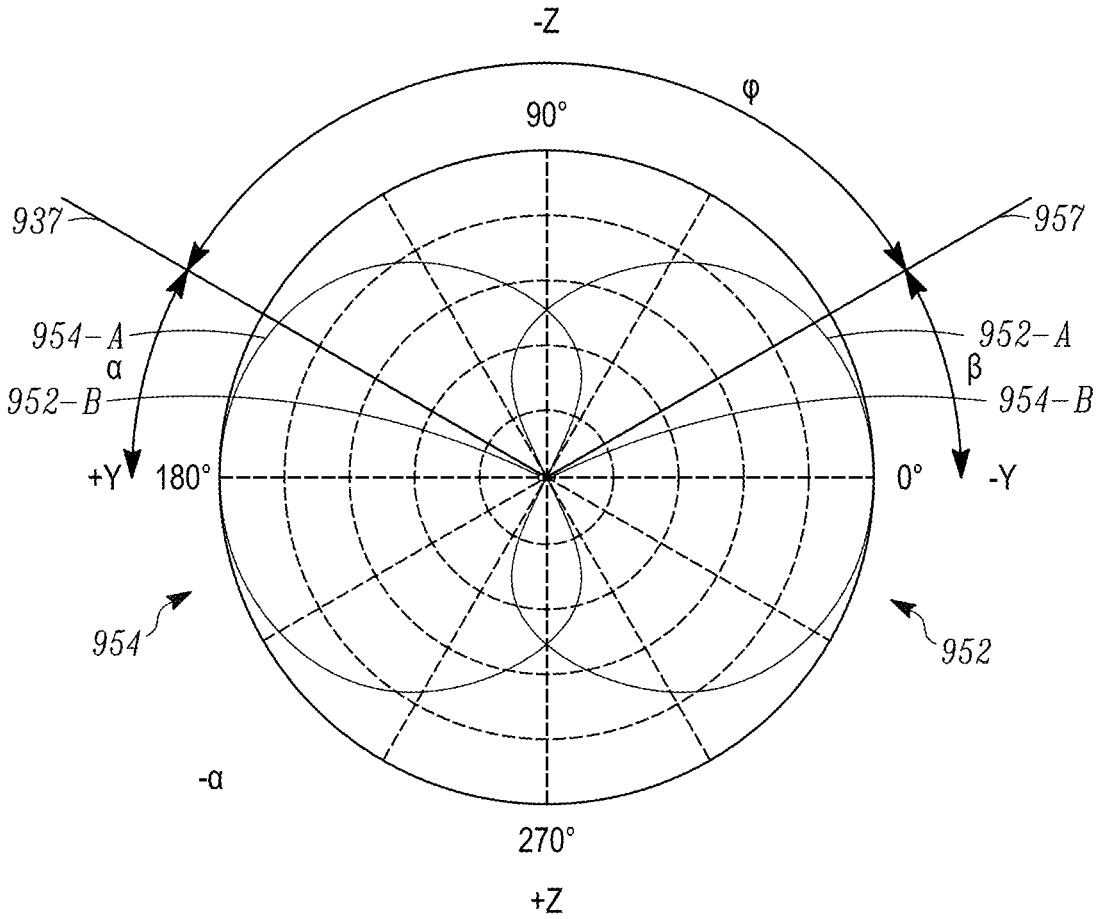
FIG. 9A is an exemplary polar graph of a right-side-oriented beamformed audio signal and a left-side-oriented beamformed audio signal generated by the audio processing system in accordance with one implementation of some of the disclosed embodiments.

FIG. 9A is an exemplary polar graph of a right-side-oriented beamformed audio signal 952 and a left-side-oriented beamformed audio signal 954 generated by the audio processing system 500 in accordance with one implementation of some of the disclosed embodiments.

As illustrated in FIG. 9A, the right-side-oriented beamformed audio signal 952 has a first-order directional pattern with a major lobe 952-A that is oriented towards or points in the −y-direction. This first-order directional pattern has a maximum at 0 degrees and has a relatively strong directional sensitivity to sound waves traveling towards the right-side of the apparatus 100. The right-side-oriented beamformed audio signal 952 also has a first null with a null center line 937 at approximately 150 degrees, or at an angle of approximately 30 degrees with respect to the +y-axis. The first null points towards the left-front-side of the apparatus 100, which indicates that there is little or no directional sensitivity to sound waves traveling towards the apparatus 100 that originate from the front-left of the apparatus 100. The first angular location ($\alpha$) of the first null corresponds to the first null center line 937 that corresponds to a right channel null region.

The left-side-oriented beamformed audio signal 954 also has a first-order directional pattern with a major lobe 954-A that is oriented in the +y-axis, and has a maximum at 180 degrees. This indicates that there is strong directional sensitivity to sound waves traveling towards the left-side of the apparatus 100. The left-side-oriented beamformed audio signal 954 also has a second null with a null center line at approximately 30 degrees. The second null center line 957 is at an angle of approximately 30 degrees with respect to the −y-axis. The second null points towards the front-right-side of the apparatus 100, which indicates that there is little or no directional sensitivity to sound waves traveling towards the apparatus 100 that originate from the front-right of the apparatus 100. The second angular location ($\beta$) of the second null corresponds to the second null center line 957 that corresponds to a left channel null region. The sum of the first angular location ($\alpha$) and the second angular location ($\beta$) will be equal to the difference between 180 degrees and a spacing or separation angle ($\phi$) that represents the angular spacing between the second null center line 957 and the first null center line 937. The spacing angle ($\phi$) can range between 0 and 180 degrees. In some implementations $\alpha=\beta$, meaning that both are equal to 90 degrees minus ½ ($\phi$).

Figure 9B:
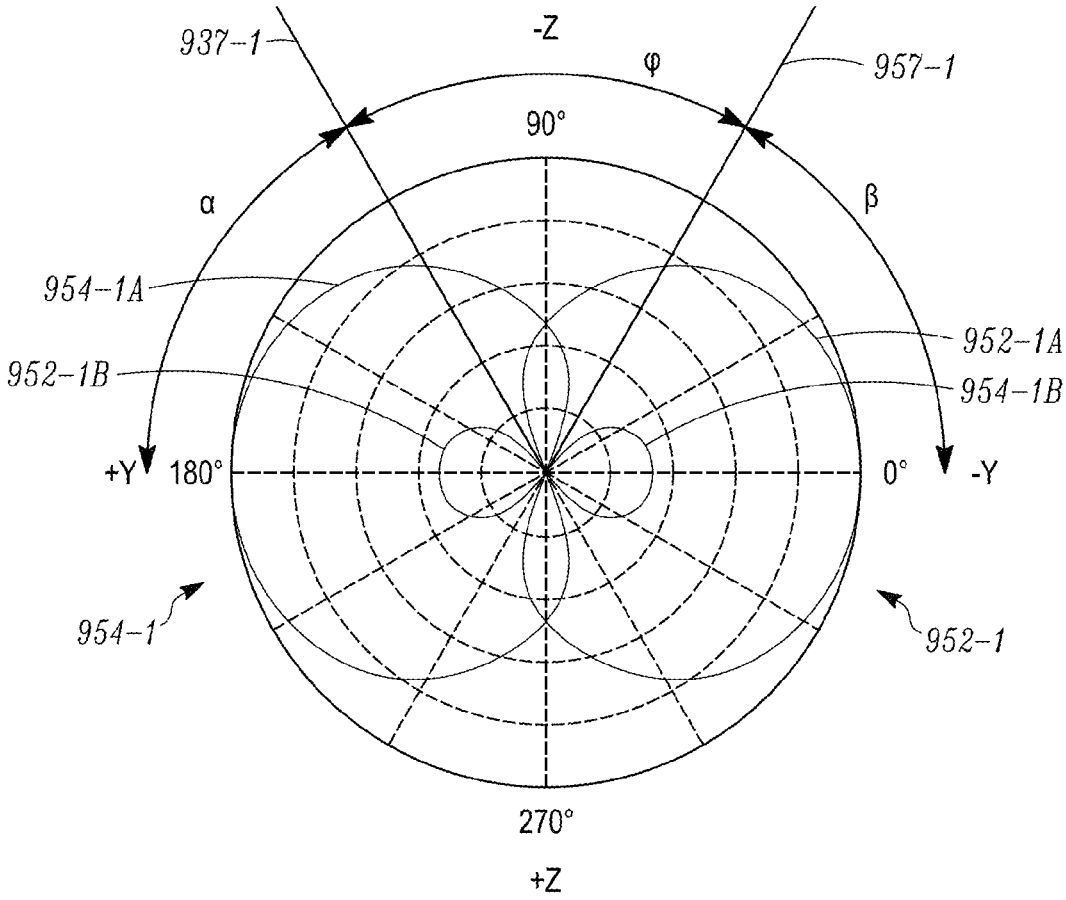
FIG. 9B is an exemplary polar graph of a right-side-oriented beamformed audio signal and a left-side-oriented beamformed audio signal generated by the audio processing system in accordance with another implementation of some of the disclosed embodiments.
Figure 9C:
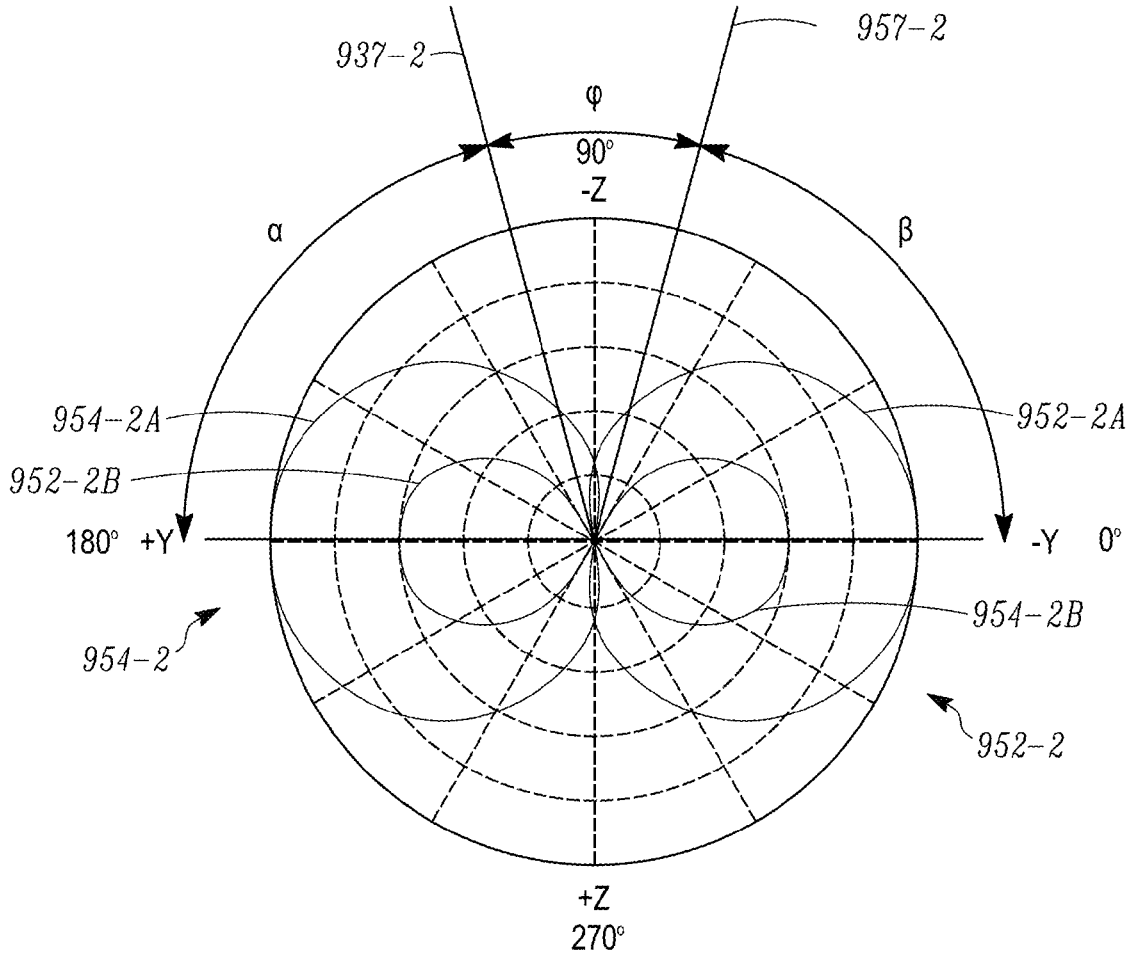
FIG. 9C is an exemplary polar graph of a right-side-oriented beamformed audio signal and a left-side-oriented beamformed audio signal generated by the audio processing system in accordance with yet another implementation of some of the disclosed embodiments.

To illustrate examples with reference to FIGS. 9B and 9C, it can be assumed that the null settings in FIG. 9A could be used, for example, when a relatively wide the field of view is desired by decreasing a zoom control signal to steer the nulls to the specified locations.

FIG. 9B is an exemplary polar graph of a right-side-oriented beamformed audio signal 952-1 and a left-side-oriented beamformed audio signal 954-1 generated by the audio processing system 500 in accordance with another implementation of some of the disclosed embodiments.

As illustrated in FIG. 9B, the right-side-oriented beamformed audio signal 952-1 has a first-order directional pattern with a major lobe 952-1A that is oriented towards or points in the −y-direction. This first-order directional pattern has a maximum at 0 degrees and has a relatively strong directional sensitivity to sound waves traveling towards the right-side of the apparatus 100. The right-side-oriented beamformed audio signal 952-1 also has a first null with a null center line 937-1 at approximately 120 degrees. The first null center line 937-1 is thus at an angle of approximately 60 degrees with respect to the +y-axis. The first null points towards the left-front-side of the apparatus 100, which indicates that there is little or no directional sensitivity to sound waves traveling towards the apparatus 100 that originate from the front-left of the apparatus 100. The first angular location ($\alpha$) of the first null corresponds to the first null center line 937-1 that corresponds to a right channel null region.

The left-side-oriented beamformed audio signal 954-1 also has a first-order directional pattern with a major lobe 954-1A that is oriented in the +y-axis, and has a maximum at 180 degrees. This indicates that there is strong directional sensitivity to sound waves traveling towards the left-side of the apparatus 100. The left-side-oriented beamformed audio signal 954-1 also has a second null with a null center line 957-1 at approximately 60 degrees. Thus, the second null center line 957-1 is at an angle of approximately 60 degrees with respect to the −y-axis. The second null points towards the front-right-side of the apparatus 100, which indicates that there is little or no directional sensitivity to sound waves traveling towards the apparatus 100 that originate from the front-right of the apparatus 100. The second angular location ($\beta$) of the second null corresponds to the second null center line 957-1 that corresponds to a left channel null region.

In comparison to FIG. 9A, the $\alpha$ and $\beta$ values are increased in FIG. 9B. This could be accomplished, for example, by increasing the zoom control signal to narrow the angular field of view. The zoom control signal or the angular field of view could then be used as the imaging signal at the automated null controller to generate a null control signal that would set the $\alpha$ and $\beta$ values that are shown in FIG. 9B.

FIG. 9C is an exemplary polar graph of a right-side-oriented beamformed audio signal 952-2 and a left-side-oriented beamformed audio signal 954-2 generated by the audio processing system 500 in accordance with one implementation of some of the disclosed embodiments.

As illustrated in FIG. 9C, the right-side-oriented beamformed audio signal 952-2 has a first-order directional pattern with a major lobe 952-2A that is oriented towards or points in the −y-direction. This first-order directional pattern has a maximum at 0 degrees and has a relatively strong directional sensitivity to sound waves traveling towards the right-side of the apparatus 100. The right-side-oriented beamformed audio signal 952-2 also has a first null with a null center line 937-2 at approximately 105 degrees. The first null center line 937-2 is thus at an angle of approximately 75 degrees with respect to the +y-axis. The first null points towards the left-front-side of the apparatus 100, which indicates that there is little or no directional sensitivity to sound waves traveling towards the apparatus 100 that originate from the front-left of the apparatus 100. The first angular location ($\alpha$) of the first null corresponds to the first null center line 937-2 that corresponds to a right channel null region.

The left-side-oriented beamformed audio signal 954-2 also has a first-order directional pattern with a major lobe 954-2A that is oriented in the +y-axis, and has a maximum at 180 degrees. This indicates that there is strong directional sensitivity to sound waves traveling towards the left-side of the apparatus 100. The left-side-oriented beamformed audio signal 954-2 also has a second null with a null center line 957-2 at approximately 75 degrees. Thus, the second null center line 957-2 is at an angle of approximately 75 degrees with respect to the −y-axis. The second null points towards the front-right-side of the apparatus 100, which indicates that there is little or no directional sensitivity to sound waves traveling towards the apparatus 100 that originate from the front-right of the apparatus 100. The second angular location (β) of the second null corresponds to the second null center line 957-2 that corresponds to a left channel null region.

In comparison to FIG. 9B, the α and β values have been increased further in FIG. 9C. This could be accomplished, for example, by increasing the zoom control signal to further narrow the angular field of view even more than in FIG. 9B.

Thus, FIGS. 9A-9C generally illustrate that angular locations of the nulls can be steered (i.e., controlled or adjusted) during beamform processing based on the null control signal 965. This way the angular locations of the nulls of the beamformed audio signals 952, 954 can be controlled to enable a concert mode stereo recording to be acquired that corresponds to the video frame being viewed by the camera operator.

Although the beamformed audio signals 952, 954 shown in FIG. 9A-9C are both beamformed first order supercardioid directional beamform patterns that are either right-side-oriented or left-side-oriented, those skilled in the art will appreciate that the beamformed audio signals 952, 954 are not necessarily limited to having these particular types of first order directional patterns and that they are shown to illustrate one exemplary implementation. In other words, although the directional patterns are supercardioid-shaped (i.e., have a directivity index between that of a bidirectional pattern and a cardioid), this does not necessarily imply the beamformed audio signals are limited to having that shape, and may have any other shape that is associated with first order directional beamform patterns such as a supercardioid, dipole, hypercardioid, etc. Depending on the null control signal 565, the directional patterns can range from a nearly cardioid beamform to a nearly bidirectional beamform, or from a nearly cardioid beamform to a nearly omnidirectional beamform. Alternatively a higher order directional beamform could be used in place of the first order directional beamform.

Moreover, although the beamformed audio signals 952, 954 are illustrated as having ideal directional patterns, it will be appreciated by those skilled in the art, that these are mathematically ideal examples only and that, in some practical implementations, these idealized beamform patterns will not necessarily be achieved.

In addition, the angular locations of the null center lines are exemplary only and can generally be steered to any angular locations in the yz-plane to allow for stereo recordings to be recorded or to allow for rear-side sound sources (e.g., operator narration) to be cancelled when desired. In other implementations in which nulls are not steered to cancel rear-side sound sources, the rear-side oriented portions of the beamformed audio signals 952, 954 can be used to acquire rear-side stereo sound sources.

Although not explicitly described above, any of the embodiments or implementations of the null control signals that were described above with reference to FIG. 5 can be applied equally in all of the embodiments illustrated and described herein.

Figure 10:
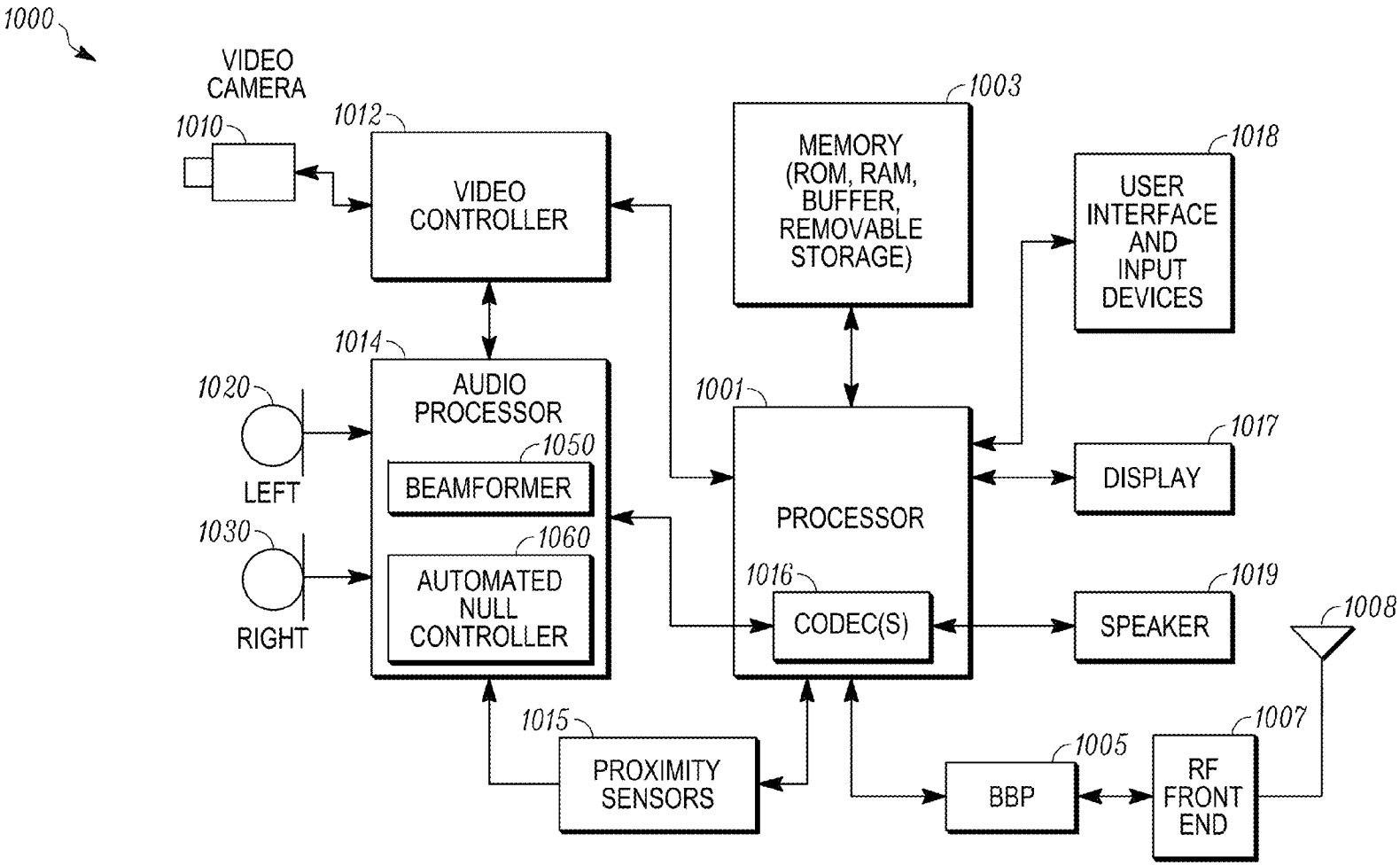
FIG. 10 is a block diagram of an electronic apparatus that can be used in an implementation of the disclosed embodiments.

FIG. 10 is a block diagram of an electronic apparatus 1000 that can be used in one implementation of the disclosed embodiments. In the particular example illustrated in FIG. 10, the electronic apparatus is implemented as a wireless computing device, such as a mobile telephone, that is capable of communicating over the air via a radio frequency (RF) channel.

The wireless computing device 1000 comprises a processor 1001, a memory 1003 (including program memory for storing operating instructions that are executed by the processor 1001, a buffer memory, and/or a removable storage unit), a baseband processor (BBP) 1005, an RF front end module 1007, an antenna 1008, a video camera 1010, a video controller 1012, an audio processor 1014, front and/or rear proximity sensors 1015, audio coders/decoders (CODECs) 1016, a display 1017, a user interface 1018 that includes input devices (keyboards, touch screens, etc.), a speaker 1019 (i.e., a speaker used for listening by a user of the device 1000) and two or more microphones 1020, 1030. The various blocks can couple to one another as illustrated in FIG. 10 via a bus or other connection. The wireless computing device 1000 can also contain a power source such as a battery (not shown) or wired transformer. The wireless computing device 1000 can be an integrated unit containing at least all the elements depicted in FIG. 10, as well as any other elements necessary for the wireless computing device 1000 to perform its particular functions.

As described above, the microphones 1020, 1030 can operate in conjunction with the audio processor 1014 to enable acquisition of audio information that originates on the front-side of the wireless computing device 1000, and/or to cancel audio information that originates on the rear-side of the wireless computing device 1000. The automated null controller 1060 that is described above can be implemented at the audio processor 1014 or external to the audio processor 1014. The automated null controller 1060 can use an imaging signal provided from one or more of the processor 1001, the camera 1010, the video controller 1012, the proximity sensors 1015, and the user interface 1018 to generate a null control signal that is provided to the beamformer 1050. The beamformer 1050 processes the output signals from the microphones 1020, 1030 to generate one or more beamformed audio signals, and controls or "steers" the angular locations of one or more nulls of each of beamformed audio signals during processing based on the null control signal.

The other blocks in FIG. 10 are conventional features in this one exemplary operating environment, and therefore for sake of brevity will not be described in detail herein.

As such, a directional stereo acquisition and recording system can be implemented. One of the benefits of this system are improved stereo separation effect by constructing directional microphone patterns and the ability to null out noise and sound from unwanted directions while using only two microphones. In addition, the variable pattern forming aspects of the invention can be coupled to a variable zoom video camera to make the sound pickup field proportionate to the video angle of view by manipulation of the microphone pattern null points. In some embodiments, operator cancellation inherently results in a specific subject-side null configuration.

It should be appreciated that the exemplary embodiments described with reference to FIG. 1-10 are not limiting and that other variations exist. It should also be understood that various changes can be made without departing from the scope of the invention as set forth in the appended claims and the legal equivalents thereof. The embodiments described with reference to FIGS. 1-10 can be implemented a wide variety of different implementations and different types of portable electronic devices.

The methods shown here use omnidirectional pressure microphones, but those skilled in the art would appreciate the same results could be obtained with opposing unidirectional microphones oriented along the y-axis, or with a single omnidirectional microphone and a single gradient microphone oriented along the y-axis. A unidirectional microphone here is any pressure gradient microphones, not including bidirectional, such as a cardioid, supercardioid, hypercardioid, etc. The use of these other microphone capsules would only require the use of a different beamforming algorithm in the processing module 450, 550, 1014.

Those of skill will appreciate that the various illustrative logical blocks, modules, circuits, and steps described in connection with the embodiments disclosed herein may be implemented as electronic hardware, computer software, or combinations of both. Some of the embodiments and implementations are described above in terms of functional and/or logical block components (or modules) and various processing steps. However, it should be appreciated that such block components (or modules) may be realized by any number of hardware, software, and/or firmware components configured to perform the specified functions. As used herein the term "module" refers to a device, a circuit, an electrical component, and/or a software based component for performing a task. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. For example, an embodiment of a system or a component may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments described herein are merely exemplary implementations The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

Furthermore, the connecting lines or arrows shown in the various figures contained herein are intended to represent example functional relationships and/or couplings between the various elements. Many alternative or additional functional relationships or couplings may be present in a practical embodiment.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. An apparatus for recording one or more subjects by a camera operator, the apparatus having a front side oriented towards the one or more subjects and a rear side oriented towards the camera operator, the front side and the rear side being oriented in opposite directions along a first axis, and a right side and a left side oriented in opposite directions along a second axis that is perpendicular to the first axis, the apparatus comprising:

a first microphone, located near the right side, that generates a first signal;

a second microphone, located near the left side, that generates a second signal;

an automated null controller that generates a null control signal based on an imaging signal;

a rear-side proximity sensor, coupled to the automated null controller, that generates a rear-side proximity sensor signal that corresponds to a distance between the camera operator and the apparatus;

a beamforming module, coupled to the first microphone, the second microphone, and the automated null controller, that processes the first signal and the second signal based on the null control signal to generate:

a right beamformed audio signal having a first directional pattern having at least one first null, and a left beamformed audio signal having a second directional pattern having at least one second null, wherein the first angular location (α) of the at least one first null and the second angular location (β) of the at least one second null is steered based on the null control signal such that the first null and the second null are oriented to cancel sound that originates from the rear side at the distance.

2. The apparatus of claim 1, further comprising:

a video camera, coupled to the automated null controller, for producing the imaging signal.

3. The apparatus of claim 2, wherein the imaging signal is based on an angular field of view of a video frame of the video camera.

4. The apparatus of claim 3, wherein the first angular location (α) and the second angular location (β), relative to an axis through a first microphone port and a second microphone port, increases as the angular field of view is decreased.

5. The apparatus of claim 3, wherein the first angular location (α) and the second angular location (β), relative to an axis through a first microphone port and a second microphone port, decreases as the angular field of view is increased.

6. The apparatus of claim 2, wherein the imaging signal is based on focal distance for the video camera.

7. The apparatus of claim 6, wherein the first angular location (α) and the second angular location (β), relative to an axis through a first microphone port and a second microphone port, increases as the focal distance is increased.

8. The apparatus of claim 6, wherein the first angular location (α) and the second angular location (β), relative to an axis through a first microphone port and a second microphone port, decreases as the focal distance is decreased.

9. The apparatus of claim 2, wherein the imaging signal is based on a zoom control signal for the video camera that is controlled by a user interface.

10. The apparatus of claim 9, wherein the zoom control signal for the video camera is a digital zoom control signal.

11. The apparatus of claim 9, wherein the zoom control signal for the video camera is an optical zoom control signal.

12. The apparatus of claim 9, wherein the first angular location (α) and the second angular location (β), relative to an axis through a first microphone port and a second microphone port, increases as the zoom control signal is increased.

13. The apparatus of claim 9, wherein the first angular location (α) and the second angular location (β), relative to an axis through a first microphone port and a second microphone port, decreases as the zoom control signal is decreased.

14. The apparatus of claim 1, further comprising:

a predetermined distance value stored in memory, wherein the null control signal is based on the predetermined distance value.

15. The apparatus of claim 1, wherein the at least one first null comprises a first null point oriented towards the front side and a second null point oriented toward the rear side, and wherein the at least one second null comprises a third null point oriented towards the front side and a fourth null point oriented toward the rear side.

16. The apparatus of claim 15:

wherein the imaging signal is based on the rear-side proximity sensor signal.

17. A method in an apparatus for recording one or more subjects oriented towards a front side of the apparatus by a camera operator oriented towards a rear side of the apparatus, the front side and the rear side being oriented in opposite directions along a first axis, the method comprising:

generating a null control signal based on an imaging signal;

generating a rear-side proximity sensor signal that corresponds to a distance between the camera operator and the apparatus;

processing, based on the null control signal, a first signal from a first microphone and a second signal from a second microphone located left of the first microphone;

generating a right beamformed audio signal having a first directional pattern having at least one first null; and generating a left beamformed audio signal having a second directional pattern having at least one second null, wherein a first angular location (α) of the at least one first null and a second angular location (β) of the at least one second null is steered based on the null control signal such that the first null and the second null are oriented to cancel sound that originates from the rear side at the distance.

18. The method of claim 17, further comprising:

generating the imaging signal at a video camera, wherein the imaging signal is based on one or more of: an angular field of view of a video frame of the video camera, a focal distance for the video camera, the rear-side proximity sensor signal, and a zoom control signal for the video camera.

19. The method of claim 17 wherein the generating a right beamformed audio signal comprises:

setting the first angular location (α) to attenuate signals from audio sources to a front-left, and where the generating a left beamformed audio signal comprises:

setting the second angular location (β) to attenuate signals from audio sources to a front-right.

* * * * *